US009061870B2

(12) United States Patent
Fields et al.

(10) Patent No.: US 9,061,870 B2
(45) Date of Patent: Jun. 23, 2015

(54) WINCH

(71) Applicants: Robert Graham Fields, Havant (GB); Oliver Peter Gregory Falconer, Porrtsmouth (GB)

(72) Inventors: Robert Graham Fields, Havant (GB); Oliver Peter Gregory Falconer, Porrtsmouth (GB)

(73) Assignee: LEWMAR LIMITED, Hampshire (GB)

( * ) Notice: Subject to any disclaimer, the term of this patent is extended or adjusted under 35 U.S.C. 154(b) by 58 days.

(21) Appl. No.: 13/667,481

(22) Filed: Nov. 2, 2012

(65) Prior Publication Data

US 2013/0119329 A1 May 16, 2013

Related U.S. Application Data

(60) Provisional application No. 61/558,535, filed on Nov. 11, 2011.

(51) Int. Cl.
*B66D 1/14* (2006.01)
*B66D 1/74* (2006.01)

(52) U.S. Cl.
CPC ..... *B66D 1/7484* (2013.01); *B66D 1/7494* (2013.01); *B66D 1/7431* (2013.01)

(58) Field of Classification Search
USPC ..... 254/342, 344, 345, 346, 362
See application file for complete search history.

(56) References Cited

U.S. PATENT DOCUMENTS

| | | | |
|---|---|---|---|
| 2,926,867 | A | 3/1960 | Nardone |
| 3,145,974 | A | 8/1964 | Short |
| 3,670,589 | A | 6/1972 | Carter |
| 3,712,155 | A | 1/1973 | Stommel et al. |
| 3,728,914 | A | 4/1973 | Guangorena et al. |
| 3,799,005 | A | 3/1974 | Koehler |
| 3,802,665 | A | 4/1974 | Fawcett |
| 3,868,953 | A | 3/1975 | Roll |
| 3,927,580 | A | 12/1975 | Fawcett |
| 3,985,340 | A | 10/1976 | Guangorena |
| 4,093,185 | A | 6/1978 | Newell |
| 4,120,486 | A | 10/1978 | Mehnert |
| 4,130,271 | A | 12/1978 | Merriman |
| 4,151,980 | A | 5/1979 | Burton et al. |

(Continued)

FOREIGN PATENT DOCUMENTS

| | | |
|---|---|---|
| DE | 201 12015 | 7/2002 |
| EP | 1125885 A2 | 8/2001 |

(Continued)

OTHER PUBLICATIONS

Lewmar, "Winches and Marine Hardware 1979/80" brochure, cover pages, circa 1980, (2 Pages).

(Continued)

*Primary Examiner* — Emmanuel M Marcelo
*Assistant Examiner* — Angela Caligiuri
(74) *Attorney, Agent, or Firm* — Leason Ellis LLP

(57) ABSTRACT

A winch for a sailboat comprises a support for mounting the winch with respect to a sailboat, a winch drum rotatable with respect to the support, a ring gear fixed with respect to the winch drum, a main drive gear meshing with the ring gear for driving rotation of the winch drum, a manual drive spindle 300 and a motor gear shaft 114. Forward winding of the winch drum in a first gearing ratio and in a second gearing ratio which are selected depending on the direction of rotation of the manual drive spindle. Gear trains provide the first and second gearing ratios. Manual and motorized operational arrangements are possible.

13 Claims, 22 Drawing Sheets

(56) References Cited

U.S. PATENT DOCUMENTS

| | | | | |
|---|---|---|---|---|
| 4,208,036 | A | 6/1980 | Huggett et al. | |
| 4,278,217 | A | 7/1981 | Blackwell | |
| 4,333,362 | A | 6/1982 | Sugioka et al. | |
| 4,386,760 | A | 6/1983 | Hutton | |
| 4,453,701 | A | 6/1984 | Huggett | |
| 4,667,934 | A * | 5/1987 | Ottemann | 254/344 |
| 4,688,765 | A | 8/1987 | Guangorena | |
| 4,699,360 | A | 10/1987 | Van der Aa | |
| 4,815,710 | A | 3/1989 | Bonassi | |
| 4,892,291 | A | 1/1990 | Shuker et al. | |
| 4,898,364 | A | 2/1990 | Shuker et al. | |
| 4,974,814 | A | 12/1990 | Cundy | |
| 5,048,799 | A | 9/1991 | Aronowitsch et al. | |
| 5,314,166 | A | 5/1994 | Muir | |
| 5,368,279 | A | 11/1994 | Ottemann et al. | |
| 5,516,082 | A | 5/1996 | Barandiaran | |
| 5,871,069 | A | 2/1999 | Carmitchel | |
| 6,431,103 | B1 * | 8/2002 | Meyerdierks | 114/218 |
| 6,916,267 | B2 | 7/2005 | Jones et al. | |
| 7,520,490 | B1 | 4/2009 | Lee | |
| 8,695,945 | B2 | 4/2014 | Guyard | |
| 8,820,720 | B2 | 9/2014 | Fields et al. | |
| 2002/0092454 | A1 | 7/2002 | Meyerdierks | |
| 2004/0149974 | A1 | 8/2004 | Chambers | |
| 2008/0203369 | A1 | 8/2008 | Asmussen | |
| 2010/0148139 | A1 | 6/2010 | Anderson et al. | |
| 2011/0042633 | A1 | 2/2011 | Mann | |
| 2013/0056694 | A1 | 3/2013 | Wilkins et al. | |

FOREIGN PATENT DOCUMENTS

| | | | |
|---|---|---|---|
| EP | 1852386 | A1 | 11/2007 |
| EP | 1985575 | A1 | 10/2008 |
| GB | 1461757 | A | 1/1977 |
| GB | 2108072 | A | 5/1983 |
| GB | A-2276137 | | 9/1994 |
| WO | WO 2009136999 | | 11/2009 |
| WO | WO2011/005172 | | 1/2011 |

OTHER PUBLICATIONS

Lewmar, "Winches and Marine Hardware 1979/80" brochure, pp. 8 and 9, circa 1980 (2 Pages).

Lewmar, "Marine Equipment" brochure, cover page, circa 1995 (1 Page).

Lewmar, "Marine Equipment" brochure, pp. 14 and 15, circa 1995 (2 Pages).

Lewmar, Service manual, "Volume 5 Specials," circa 1985 (copyright notice) (24 Pages).

Lewmar, Service manual, "Volume 6 Specials," circa 1992 (copyright notice) (36 Pages).

* cited by examiner

WINCH

This application claims the benefit of priority under 35 U.S.C. Section 119(e) of U.S. Application Ser. No. 61/558,535, filed on Nov. 11, 2011, entitled "Winch," which is hereby incorporated by reference in its entirety.

BACKGROUND TO THE INVENTION

1. Field of the Invention

The present invention relates to winches for watercraft, particularly sailboats. The invention has particular, but not exclusive, applicability to winches that are powered by a motor and capable of being wound by operation of the motor in the forwards direction and in the reverse direction.

2. Related Art

Winches are well known for use in maneuvering the sails on a sailboat by controlling the tension on the boat's running and rigging lines. These lines for example may be sail sheets and sail halyards, which are referred to collectively in this disclosure as "ropes". Each rope can be considered to have a loaded end (connected to a sail) and an unloaded end (the "tail" of the rope, which may be collected in a cockpit of the boat).

A typical winch includes a rotatable drum mounted with respect to a deck of the boat. The loaded end of the rope is drawn onto the drum by rotation of the drum. Hauling the loaded end of the rope onto the drum in this way is referred to in this disclosure as "forward winding" of the winch. This rotation is typically clockwise rotation, although this is not essential. Rotation of the drum may be achieved by hand-cranking of the winch using a winch handle inserted into a drive socket at the upper end of the winch. Additionally or alternatively, the winch may be rotated by operation of an electric or hydraulic motor. Reduction gearing is provided in order to improve mechanical advantage and allow the rope to be drawn onto the drum even under heavy loads. Particularly for hand-cranking operation of the winch, there may be provided at least two (and sometimes three or four) reduction gear ratios. In the case of two gear ratios, the relevant gear is typically selected simply by the user driving the winch handle in either the clockwise or anticlockwise direction.

There are typically three or four turns of rope held on the winch drum. The diameter of the winch drum typically enlarges slightly from the axial lower end of the drum towards the axial upper end of the drum. This encourages the loaded end of the rope to be located at the axial lower end of the drum. The three or four turns of rope on the drum typically provide a great deal of frictional hold on the rope. The unloaded end of the rope may therefore be simply held in a cleat in order to retain the rope on the winch and retain the load on the loaded end of the rope. However, it is common to incorporate a cleat onto the winch in the form of a self-tailing arrangement, described in more detail below.

The self-tailing arrangement is typically located at the upper end of the winch. The self-tailing arrangement has a pair of opposed rope lock rings with optional gripping features. The rope lock rings are typically spring biased towards each other to allow a range of rope diameters to fit into the channel defined between the rope lock rings and be gripped by the rope lock rings. The rope lock rings rotate with the drum. A feeder arm is provided in order to guide rope from the upper end of the drum into the channel between the rope lock rings. The feeder arm is fixed with respect to the winch, so that the feeder arm does not rotate with the winch drum or the rope lock rings. The rope then passes along the channel between the rope lock rings for nearly a full turn around the winch, the rope exiting the channel at an unloaded end of the rope adjacent the feeder arm, optionally guided out of the channel between the rope lock rings by a suitable guide feature typically known as a stripper. Forward winding of the winch therefore draws loaded rope onto the lower end of the drum, thereby reducing the length of rope that is loaded between the winch and the sail. An amount of rope corresponding to the amount drawn onto the winch drum is guided into the self-tailing unit by the feeder arm. A corresponding amount of rope is paid out the self-tailing unit via the stripper and into, e.g. the cockpit of the boat, thereby to increase the length of rope that is unloaded. The rope is gripped (cleated) in the self-tailing arrangement by the rope lock rings.

As well as hauling rope in, it is also required to pay rope out from the winch, in order to manoeuvre the sails to an optimum position as determined by the skipper of the boat. With self-tailing winches of the type described above, rope is typically paid out manually. The operator takes the unloaded rope adjacent the self tailing arrangement and pulls the rope radially out of the channel defined by the rope lock rings. The operator applies some tension to the rope in order to replace the gripping force provided by the self-tailing arrangement. The operator may let off one or two turns of rope from the winch drum. The operator must then carefully pay out the rope, to allow it to slide around the remaining turns on the winch drum. As will be understood, this operation is potentially hazardous, given the high loads experienced by the ropes on typical sailboats. There is risk of injury to the operator, risk of damage to the sailboat and a likelihood of (at least temporary) loss of control of at least some aspect of the sailboat if the rope is accidentally let out in an uncontrolled manner.

It is known to address this problem using a winch which is capable of powered reverse winding. In the present disclosure, "reverse winding" relates to controlled rotation of the winch drum in the opposite direction to forward winding, reverse winding thereby increasing the length of loaded rope and decreasing the length of unloaded rope. However, providing a winch with powered reverse winding capability is relatively complex since typically the additional capability of the winch must not compromise the primary function of the winch to haul in loaded rope as efficiently as possible.

There are known powered reverse winding winches. GB-A-2276137 discloses a powered winch which has an electric motor capable of driving the winch in the forward direction with different gear ratios. Reverse winding of the winch is made possible by the inclusion of a sun and planetary gear mechanism controlled by the motor. This arrangement is complex and would be difficult to manufacture and assemble.

Operation of electrically powered winches is typically carried out by activation of suitable switches in order to supply power to the electric motor. For some known powered winches, it is necessary to provide several controls, in order to for the user to select the gear ratio to be used by the winch and in order for the user to activate power to the winch. For example, a control (which may be mechanical or electrical) may be provided in order to select one of a several modes of operation e.g. "forward wind only, different speeds" or "forward/reverse wind". One or more further controls (typically one or more switches) must then be activated in order to deliver power to the electric motor, allowing the user to select, for example "fast forward wind", "slow forward wind" or "reverse wind", but only after operation and/or inspection of at least two controls. Such a non-intuitive control system can be difficult for the user to operate in challenging sailing conditions.

Another known winch is disclosed in WO2011/005172. The winch is disclosed as being capable of powered forward winding and powered reverse winding, however it is not explained in WO2011/005172 how gearing may be arranged in the winch in order to allow powered reverse winding. WO2011/005172 discloses a self-tailing arrangement having an upper rope lock ring and a lower rope lock ring, both lock rings being rotatable with the winch drum. The lower rope lock ring is held in a fixed axial position (but is rotatable as previously mentioned) and the upper rope lock ring is skew spring-mounted. During rotation of the winch drum, the upper rope lock ring is subjected to a dynamic asymmetric motion pattern so that the channel between the rope lock rings is at its widest adjacent the self-tailing arm and at its narrowest diametrically opposite the self-tailing arm. This dynamic asymmetric motion pattern is provided by a forcing means inserted into the channel between the rope lock rings forcing the rope lock rings apart against the force of the springs acting on the upper rope lock ring. The rope lock rings additionally have a bulge of uniform height formed around the self-tailing arrangement. The effect of this, combined with the motion pattern of the rope lock rings, is that the rope is firmly held in the channel between the rope lock rings at the position diametrically opposite the self-tailing arm, and yet the rope can be fed into and fed out of the self-tailing arrangement, past the bulge, at a position adjacent the self-tailing arm due to the forcing-open of the rope lock rings. This is stated to allow the unloaded rope to be more easily and automatically fed into the self-tailing arrangement during reverse winding.

SUMMARY OF THE INVENTION

The present invention has been devised in order to address at least one of the above problems. Preferably, the present invention reduces, ameliorates, avoids or overcomes at least one of the above problems.

In a first development, the present inventors have realised that it would be advantageous to provide a self-tailing arrangement that provides improved performance during reverse winding of the winch, particularly with respect to reliability of operation and ease of insertion of the rope by the user into the self-tailing arrangement.

Accordingly, in a first preferred aspect, the present invention provides a self-tailing winch for a sailboat comprising:

- a support for mounting the winch with respect to a sailboat;
- a winch drum rotatable with respect to the support about a rotational axis; and
- a self-tailing arrangement disposed axially adjacent the winch drum, wherein the self-tailing arrangement comprises:

- a rope guide channel extending circumferentially around the self-tailing assembly, the rope guide channel being defined by upper and lower rope guide rings, the upper and lower rope guide rings being rotatable with the drum and adapted to grip rope in the rope guide channel;
- a feeder arm for guiding rope between the drum and the rope guide channel, the feeder arm being fixed with respect to the support; and
- a retainer guide for guiding rope between the rope guide channel and an unloaded end of the rope, wherein the drum is rotatable with respect to the retainer guide and the retainer guide is spring mounted to allow movement of the retainer guide in a direction substantially parallel to the rotational axis of the winch drum, the retainer guide having a retainer lip extending partially circumferentially around the self-tailing assembly to at least partially enclose a portion of the rope guide channel, the retainer guide further defining at least one side of an opening adjacent the retainer lip, the opening being sized to conduct rope through the opening during reverse winding of the winch, the rope thereby being retained in the rope guide channel by the retainer lip.

In a second preferred aspect, the present invention provides a method of operating a winch according to the first aspect, the method including the step of reverse winding the winch.

Preferably, at least one of the upper and lower rope guide rings is spring mounted to be urged towards the other. This allows the rope guide channel to adopt a size suitable for a range of rope diameters. Preferably, the spring mounting of the retainer guide is via the same spring mounting as the upper and/or lower rope guide rings.

Preferably, the width of the rope guide channel is constant around the self-tailing arrangement during normal use of the winch. This allows the self-tailing arrangement to exert a consistent and uniform grip on the rope along the length of the rope held in the rope guide channel.

Preferably, the retainer lip extends for less than about 180° circumferentially around the self-tailing assembly. More preferably, the retainer lip extends for less than about 120° around the self-tailing assembly. The retainer lip preferably extends for more than about 45° around the self-tailing assembly. More preferably, the retainer lip extends for more than about 90° around the self-tailing assembly.

Preferably, the opening for conducting rope is defined at one side by a portion of the retainer lip and at the opposite side by a separate feature. For example, the separate feature may be an extractor located in the rope guide channel. Alternatively, the separate feature may be the feeder arm.

Preferably, the retainer lip has an asymmetric profile when viewed radially. The retainer lip preferably has a reverse winding guide portion. This is located adjacent the opening though which rope is conducted. At the opposite circumferential end of the retainer lip there is preferably provided a tapered portion. The reverse winding guide portion preferably has a sloped profile from the opening to the full axial extent (i.e. height or depth) of the retainer lip. Similarly, the tapered portion preferably has a sloped profile from the full axial extent of the retainer lip to the minimum axial extent of the retainer lip. The slope of the reverse winding guide portion is preferably steeper than the slope of the tapered portion.

The effect of the steeper slope of the reverse winding guide portion is that during reverse winding, the rope is easily guided behind the retainer lip and into the rope guide channel. The steep slope here means that the rope cannot easily accidentally be moved over the retainer lip to come out of the rope guide channel during reverse winding. As will be understood, if the rope does come out of the rope guide channel accidentally during reverse winding, then this may lead to a serious safety hazard because the rope may come off the self-tailing arrangement altogether, leading to uncontrolled letting-out of rope from the winch.

However, it is preferred of course that the reverse winding portion will allow the user to extract the rope from the rope guide channel from the unloaded end of the rope by manually diverting the unloaded rope over the retainer lip and out of the rope guide channel. This can be achieved without the user needing to touch the retainer lip.

The effect of the lower slope of the tapered portion is intended to be the opposite of the reverse winding portion, allowing the rope to fit over the retainer lip and press the retainer guide against its spring mounting during forward winding. In use, the user may wind the rope a suitable number of turns around the winch drum and then over the feeder arm and into the rope guide channel. When the winch is to be driven manually, the user may fit the rope into the full circumference of the rope guide channel by using the rope to cam open the retainer guide using the tapered portion and insert rope into the rope guide channel behind the retainer lip. When the winch is to be driven by the motor, it may be preferred for the user to fit the rope only into the part of the rope guide channel adjacent the feeder arm and then to forward wind the winch drum in order to allow the rope to the be fitted automatically into the full circumference of the rope guide channel. The tapered portion assists with this by allowing the rope, as it is driven around the self-tailing arrangement, to cam open the retainer guide using the tapered portion, the retainer guide thereby being displaced axially against its spring mounting and insert rope into the rope guide channel behind the retainer lip. In each mode of operation, the end result is preferably that the rope extends around the rope guide channel, behind the retainer lip and out of the opening adjacent the reverse winding guide portion.

The steepness of the retainer lip at a particular location can be considered to be the minimum angle subtended between a tangent to the retainer lip at that location and the plane of the rope guide channel. Preferably the steepness of the retainer lip at the reverse winding guide portion is at least 30°, more preferably at least 45°, still more preferably at least 55°. Preferably the steepness of the retainer lip at the tapered portion is at most 20°, more preferably at most 15°, still more preferably at most 10°.

The retainer guide is preferably held stationary on rotation of the drum by locking engagement with the feeder arm. This provides a convenient arrangement to ensure that the opening from the retainer guide from which unloaded rope is emitted is facing a convenient direction for the user, e.g. towards a cockpit of the sailboat.

Preferably, the locking engagement with the feeder arm allows axial movement of the retainer guide against its spring mounting. For example, a suitable locking engagement may be provided by engagement of a projection (e.g. on the retainer guide) with a corresponding axial slot (e.g. on the feeder arm).

For the avoidance of doubt, it is mentioned here that the retainer guide (and particularly the retainer lip) is substantially fixed against radial movement. Here, the radial direction is to be taken as a direction perpendicular to the axis of rotation of the winch. It is preferred, for example, that the retainer guide is provided as a component that extends around the full circumference of the self-tailing assembly, e.g. in the form of a ring. This allows for convenient association of the retainer guide with the upper or (more preferably) the lower rope lock ring and helps to provide a structure that prevents radial displacement of the retainer guide with respect to the rope guide channel.

The self-tailing arrangement preferably includes a forward wind rope extractor. The use of an extractor is known in self-tailing arrangements in order to extract rope from the rope guide channel during forward winding of the winch. The forward wind extractor typically takes the form of a wedge extending from the feeder arm and into the rope guide channel in a direction opposite to the forward wind direction. This acts to prevent rope from jamming behind the feeder arm during forward winding. The self-tailing arrangement preferably also includes a reverse wind rope extractor. In view of the use of the winch for reverse winding, this is preferred in order to prevent rope from becoming jammed behind the feeder arm during reverse winding. The reverse wind extractor typically takes the form of a wedge extending from the feeder arm and into the rope guide channel in a direction opposite to the reverse wind direction. Conveniently, the reverse wind extractor may be formed integrally with the forward wind extractor.

In a second development, the present inventors have devised a mechanical driving arrangement for a winch, the driving arrangement being relatively simple but efficient and providing multi-speed manual operation combined with motorised capability for forward and reverse winding.

It is known to provide a winch which provides (at least) two forward winding winch speeds under manual operation and forward winding motorised operation. Such winches are available from Lewmar Limited under the brand name EVO™. Such winches typically provide the two forward winding speeds under manual operation using two drive trains, selectable by the direction of cranking of the winch, the two drive trains incorporating respective unidirectional drive means set in opposite senses to each other. A motor is operatively connected to a motor gear shaft via gearing, the motor gear shaft driving forward winding of the drum. However, such winches are not capable of powered reverse winding.

In a general aspect of this development, the present invention provides a third unidirectional drive means linked to the motor gear shaft, rotation of the third unidirectional drive means by the motor gear shaft in one direction causes forward winding of the winch drum and rotation of the unidirectional drive means by the motor gear shaft in the opposite direction allows reverse winding of the winch drum.

Accordingly, in a third preferred aspect of the invention, there is provided a winch for a sailboat comprising:

- a support for mounting the winch with respect to a sailboat;
- a winch drum rotatable with respect to the support;
- a ring gear fixed with respect to the winch drum;
- a main drive gear meshing with the ring gear for driving rotation of the winch drum;
- a manual drive spindle; and
- a motor gear shaft, wherein the winch is capable of manual operation for forward winding of the winch drum in a first gearing ratio and in a second gearing ratio, the first and second gearing ratios being selected depending on the direction of rotation of the manual drive spindle, the winch further comprising:

- a first gear train providing the first gearing ratio, the first gear train having a first unidirectional drive means operable to drive the main drive gear when the first unidirectional drive means is rotated in a forward direction and operable to freewheel when the first unidirectional drive means is rotated in a reverse direction; and a second gear train providing the second gearing ratio, the second gear train having a second unidirectional drive means operable to drive the main drive gear when the second unidirectional drive means is rotated in a reverse direction and operable to freewheel when the second unidirectional drive means is rotated in a forwards direction, the winch further comprising:

- a third unidirectional drive means linked to the motor gear shaft, wherein the winch is capable of motorised operation in which the winch drum is operatively linked to the motor gear shaft via the third unidirectional drive means and via at least part of the first or second gear train, and rotation of the third unidirectional drive means by the motor gear shaft in one direction drives the main drive gear and causes forward winding of the winch drum and rotation of the unidirectional drive means by the motor gear shaft in the opposite direction allows reverse winding of the winch drum.

In a fourth preferred aspect, the present invention provides a method of operating a winch according to the third aspect, the method including the step of reverse winding the winch.

Using the invention, it is therefore possible to provide an advantageous combination of modes of operation for the winch: multi-speed manual forward winding and forwards and reverse powered winding. The use of a third unidirectional drive means provides the advantage that there is no need to provide releasable engagement between the drive trains and the motor gear shaft, e.g. by means of operation of a clutch or similar.

In preferred embodiments of the invention, reverse winding of the winch drum occurs only when there is a reverse winding torque on the drum. The reverse winding torque can be applied manually (e.g. by a user turning the winch drum in reverse) but more preferably the reverse winding torque is applied by a load on a rope wrapped around the drum. In this way, the reverse winding of the winch drum preferably occurs only when there is a rope under load wrapped around the winch drum.

Preferably, the third unidirectional drive means has a first part and a second part:

(i) rotation of the first part in said one direction or rotation of the second part in said opposite direction engages the first and second parts to rotate together, and (ii) rotation of the first part in said opposite direction or rotation of the second part in said first direction allows relative rotation of the first and second parts in a freewheel configuration.

It should be noted that the first and second unidirectional drive means may have a similar configuration to the third unidirectional drive means, i.e. each having first and second parts that engage with each other in one rotation direction and freewheel relative to each other in the opposite rotation direction. As is apparent from the explanation above, the first and second unidirectional drive means are set in opposite senses to each other, so that when one is engaged, the other is freewheeling.

Any suitable unidirectional drive means may be used. Preferably, the unidirectional drive means includes a ratchet track and a corresponding arrangement of pawls.

During forward winding of the winch drum, the first and second parts of the third unidirectional drive means are typically engaged to rotate together. Preferably, also during reverse winding of the winch drum, the first and second parts of the third unidirectional drive means are engaged to rotate together. This is perhaps counter-intuitive, since it would be expected that reverse winding of the winch drum would be achieved by allowing freewheeling of the third unidirectional drive means. However, this is not preferred because this would lead to uncontrolled let-out of loaded rope from the winch drum, which would be unsafe unless additional braking means were provided for braking the reverse winding of the winch drum. Instead, having the first and second parts of the third unidirectional drive means engaged to rotate together during reverse winding means that the speed of reverse winding can be controlled by the motor, so that no additional braking means is required.

Preferably, in use, the motor gear shaft is driven by the motor via worm gearing so that the motor gear shaft is rotationally locked when the motor is not operated. This in turn locks the winch drum against reverse winding when the motor is not operated.

Preferably, when the winch is not subjected to a reverse winding torque, or to only a very low reverse winding torque, reverse operation of the motor results in relative rotation of the first and second parts of the third unidirectional drive means in a freewheel configuration. Particularly where the unidirectional drive means is provided by a ratchet and pawl arrangement or similar, this results in an audible clicking sound to indicate to the operator that the reverse operation of the motor is not being matched by reverse winding of the winch drum.

Preferably, the first gearing ratio is higher than the second gearing ratio.

The manual drive spindle is typically driven by means of a crank handle. The crank handle may be removably inserted into a corresponding drive socket, typically formed at the top of the winch.

Preferably the manual drive spindle is provided with a spindle gear wheel which engages with gear wheels of the first and second drive trains simultaneously. Rotation of the manual drive spindle (and thus the spindle gear wheel) in the reverse direction typically drives rotation of the first unidirectional drive means in the forwards direction and causes the second unidirectional drive means to freewheel. Rotation of the manual drive spindle (and thus the spindle gear wheel) in the forwards direction typically drives rotation of the second unidirectional drive means in the reverse direction and causes the first unidirectional drive means to freewheel. However, preferably, reverse winding torque on the winch drum urges the first and second unidirectional drive means so that the spindle gear wheel locks relative rotation of said gear wheels of the first and second drive trains, and thus prevents reverse winding of the winch drum.

Preferably, the spindle gear wheel is moveable into and out of engagement with at least one of said gear wheels of the first and second drive trains. Preferably, the spindle gear wheel is moveable into and out of engagement with both of said gear wheels of the first and second drive trains. When the spindle gear wheel is out of engagement, reverse winding of the winch drum becomes possible because the first and second gear trains are no longer locked with respect to each other. In this case, as explained above, reverse winding of the winch drum is then preferably under the control of the motor gear shaft.

Preferably, the spindle gear wheel is moveable axially along the principal axis of the manual drive spindle. Preferably, the spindle gear wheel is out of engagement when the crank handle is not located in the drive socket of the winch. In this way, location of the crank handle in the winch preferably determines whether or not reverse winding of the winch drum is possible.

In order to allow axial movement of the spindle gear wheel, there is preferably provided a plunger for axial travel along the manual drive spindle. The plunger preferably has first spring means for urging the spindle gear wheel towards engagement. The plunger preferably has second spring means for urging the plunger upwards in the manual drive spindle. The effect of these first and second spring means together is preferably that when the crank handle is not located in the drive socket, the second spring means urges the plunger upwards and so the spindle gear wheel out of engagement. When the crank handle is located in the drive socket, the second spring means is preferably compressed and the plunger depressed, the first spring means therefore urging the spindle gear wheel into engagement with the gear wheels of the first and second drive trains. The advantage of providing the first spring means is that the gear wheels of the first and second drive trains may not be in a suitable position to accept the spindle gear wheel. Therefore the first spring means urges the spindle gear wheel into engagement at the next available opportunity on movement of the first and/or second drive trains.

The present inventors have realised that the mechanical arrangement to allow the spindle gear wheel to be removed from the first and/or second drive trains represents a development of the invention that may be independent of the linkage used to connect the motor gear shaft to drive forwards and reverse winding of the drum.

Accordingly, in a fifth preferred aspect, there is provided a winch for a sailboat comprising:

a support for mounting the winch with respect to a sailboat;
a winch drum rotatable with respect to the support;
a ring gear fixed with respect to the winch drum;
a main drive gear meshing with the ring gear for driving rotation of the winch drum;
a manual drive spindle; and
a motor gear shaft, wherein the winch is capable of manual operation for forward winding of the winch drum in a first gearing ratio and in a second gearing ratio, the first and second gearing ratios being selected depending on the direction of rotation of the manual drive spindle, the winch further comprising:

a first gear train providing the first gearing ratio, the first gear train having a first unidirectional drive means operable to drive the main drive gear when the first unidirectional drive means is rotated in a forward direction and operable to freewheel when the first unidirectional drive means is rotated in a reverse direction; and
a second gear train providing the second gearing ratio, the second gear train having a second unidirectional drive means operable to drive the main drive gear when the second unidirectional drive means is rotated in a reverse direction and operable to freewheel when the second unidirectional drive means is rotated in a forwards direction, wherein the winch is capable of motorised operation in which the winch drum is operatively linked to the motor gear shaft via at least part of the first or second gear train, so that rotation of the motor gear shaft in one direction drives the main drive gear and causes forward winding of the winch drum and rotation of the motor gear shaft in the opposite direction allows reverse winding of the winch drum, and wherein the manual drive spindle is provided with a spindle gear wheel which engages, during manual operation of the winch, with gear wheels of the first and second drive trains simultaneously to prevent reverse winding during manual operation, the spindle gear wheel being reversibly moveable out of engagement with at least one of said gear wheels of the first and second drive trains for motor-controlled reverse winding of the drum.

In a sixth preferred aspect, the present invention provides a method of operating a winch according to the fifth aspect, the method including the step of moving the spindle gear wheel out of engagement with at least one of said gear wheels of the first and second drive trains and reverse winding the winch under motor-control.

It is expressly stated that the optional features of the spindle gear wheel set out above with respect to the third and fourth aspects of the invention are applicable in any combination with the fifth and sixth aspects of the invention.

In a further development, the present inventors have devised winch arrangements for use on sailboats that have advantages for the operator compared with known winch arrangements.

The present inventors have realised, for example, that reverse winding of the winch drum is advantageously assisted by the tangential load on the winch drum applied by loaded rope wrapped around the winch drum. The inventors have realised that this reverse winding torque can be used to power reverse winding, the speed of the reverse winding being controlled by the motor.

Accordingly, in a seventh aspect of the invention, there is provided a winch for a sailboat comprising:

a support for mounting the winch with respect to a sailboat;
a winch drum rotatable with respect to the support;
a manual drive socket for receiving a crank handle for manual driving of the winch;
a motor for powered driving of the winch, wherein the winch provides at least two manual forward winding gearing ratios selectable according to the direction of rotation of the manual drive socket, and wherein the winch provides motor-operated forward winding and motor-operated reverse winding, reverse winding being provided only when reverse-winding torque is applied to the winch drum.

In an eighth preferred aspect, the present invention provides a method of operating a winch according to the seventh aspect, the method including the step of reverse winding the winch.

Preferably, the reverse-winding torque is applied by loaded rope wrapped around the winch drum.

The present inventors have further realised that reverse winding of the winch drum carries with it significant safety implications. This is particularly the case for a winch of a size which is suitable to be manually cranked in some circumstances but which is capable of being driven by a motor.

Accordingly, in a ninth aspect of the invention, there is provided a winch for a sailboat comprising:

a support for mounting the winch with respect to a sailboat;
a winch drum rotatable with respect to the support;
a manual drive socket for receiving a crank handle for manual driving of the winch;
a motor for powered driving of the winch, wherein:

the winch provides at least two manual forward winding gearing ratios selectable according to the direction of rotation of the manual drive socket;

the winch provides motor-operated forward winding and motor-operated reverse winding; and the winch includes locking means activatable on location of a crank handle in the drive socket so that when the crank handle is located in the drive socket the winch is locked against reverse winding.

In a tenth preferred aspect, the present invention provides a method of operating a winch according to the ninth aspect, the method including the step of locating a crank handle in the drive socket of the winch.

Preferably, when the crank handle is located in the drive socket, the winch is still capable of motor-operated forward winding. This is advantageous since it allows the operator to wind in rope quickly and conveniently using a combination of motor power and manual power, without the need for removal of the handle from the winch in order to operate the motor.

Preferably, when the crank handle is located in the drive socket, the motor can be driven in a reverse-winding direction, and non-reverse winding of the winch drum is indicated to the operator by an audible signal. In this way, location of the crank handle in the drive socket does not interfere with the operation of the motor. Instead, preferably the locking means is a mechanical locking means that prevents the reverse motor drive from being transmitted to the winch drum. The provision of an audible signal (preferably a mechanically-generated audible signal) assists the user in understanding when the winch is not reverse winding. Preferably, the audible signal is a clicking sound of a unidirectional drive means in freewheel.

For example, the audible signal may be a clicking sound of a ratchet operating in freewheel.

The present inventors have further realised that forward and reverse winding of known powered winches is typically carried out using relatively non-intuitive control systems which can be difficult to operate in challenging sailing conditions.

Accordingly, in an eleventh aspect of the invention, there is provided a winch arrangement for a sailboat comprising:

a support for mounting the winch with respect to a sailboat;

a winch drum rotatable with respect to the support;

a manual drive socket for receiving a crank handle for manual driving of the winch;

a motor for powered driving of the winch; and control means for controlling the motor, wherein:

the winch provides at least two manual forward winding gearing ratios selectable according to the direction of rotation of the manual drive socket; and the winch provides motor-operated forward winding and motor-operated reverse winding, the control means having two selectable on-off controls only, a forwards control being exclusively for controlling on-off motor-operated forward winding of the winch drum and a reverse control being exclusively for controlling on-off motor-operated reverse winding of the winch drum.

In a twelfth preferred aspect, the present invention provides a method of operating a winch arrangement according to the eleventh aspect, the method including the step of activating the reverse control to reverse wind the winch.

In this way, the user is presented with an exceptionally straightforward control means, typically one button (or switch) to activate forward winding and one, different, button (or switch) to activate reverse winding. This allows the user to carry out control of the winch one-handed and intuitively. One-handed operation is important for challenging sailing conditions, where the other hand may be needed to support the user. Simple and intuitive operation is important where the user (e.g. not the owner of the sailboat but a crew member) is operating the winch for the first time.

It is to be understood that any aspect of the invention may be combined with any other aspect of the invention, e.g. in preferred embodiments of winches and winch arrangements. Any aspect of the invention may have any one or, to the extent that they are compatible, any combination of the any of the optional features set out with respect to any aspect of the invention.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS AND FURTHER OPTIONAL FEATURES OF THE INVENTION

Figure 1:
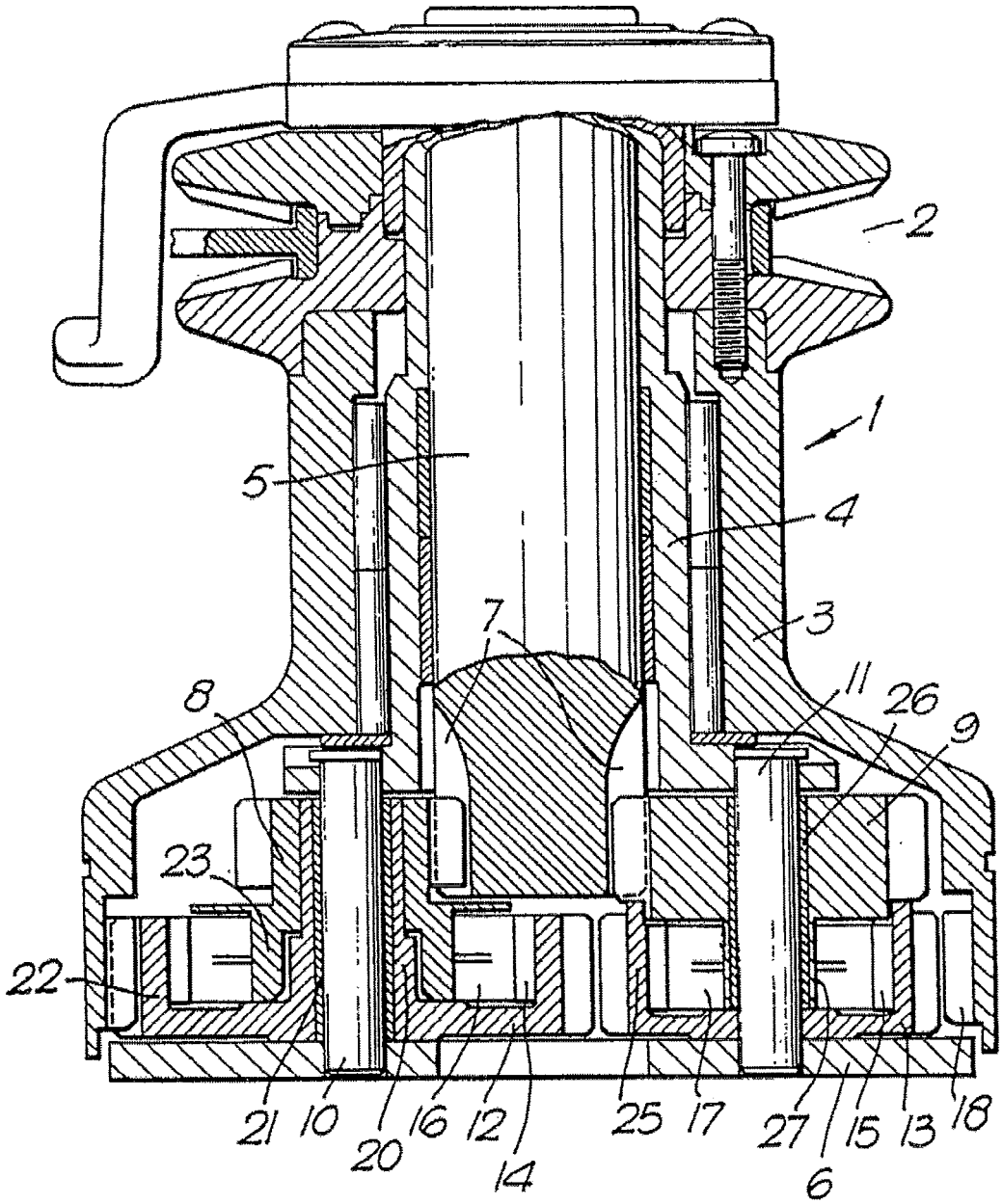
Fig. 1 PRIOR ART
FIG. 1 shows an axial sectional view of a manual winch of the prior art.
Figure 2:
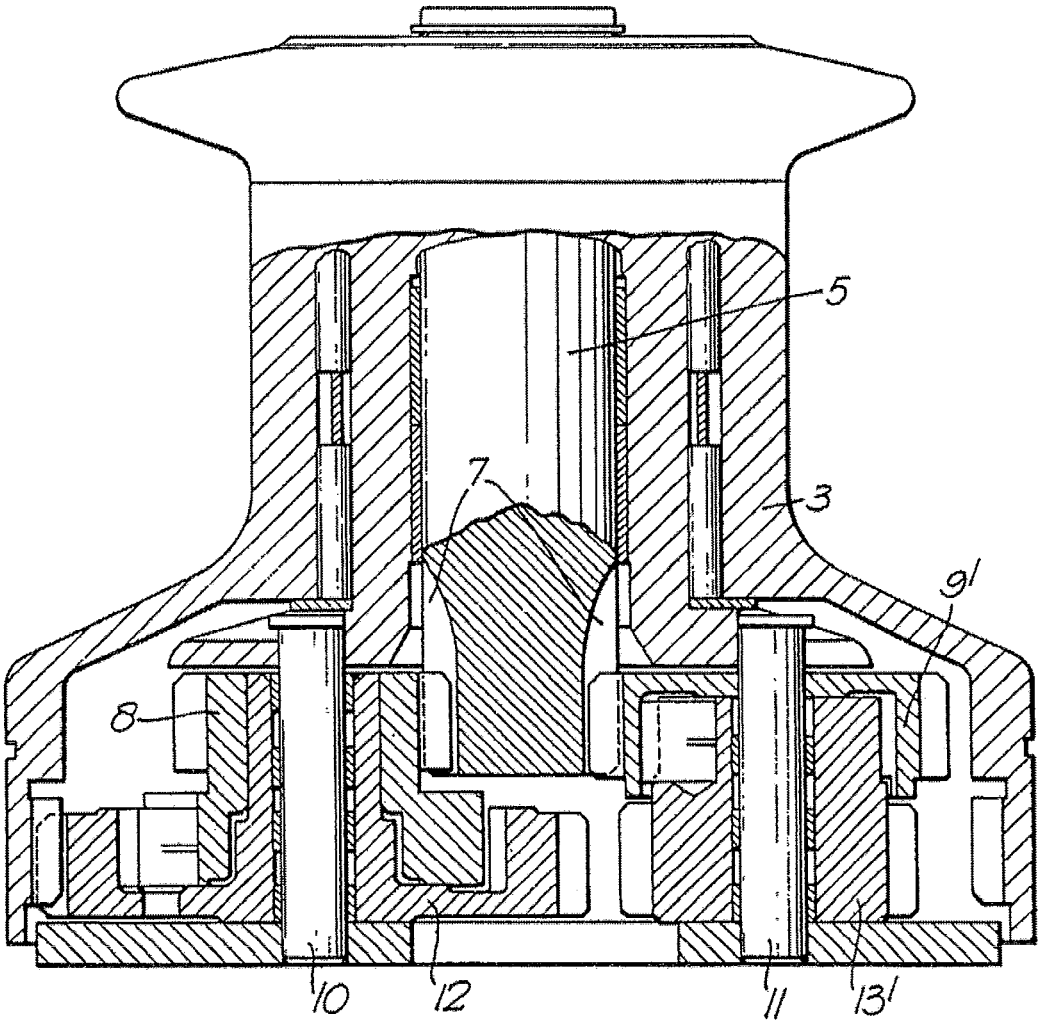
Fig. 2 PRIOR ART
FIG. 2 shows an axial partial sectional view of a manual winch of the prior art which is a modification of the winch of FIG. 1.
Figure 3:
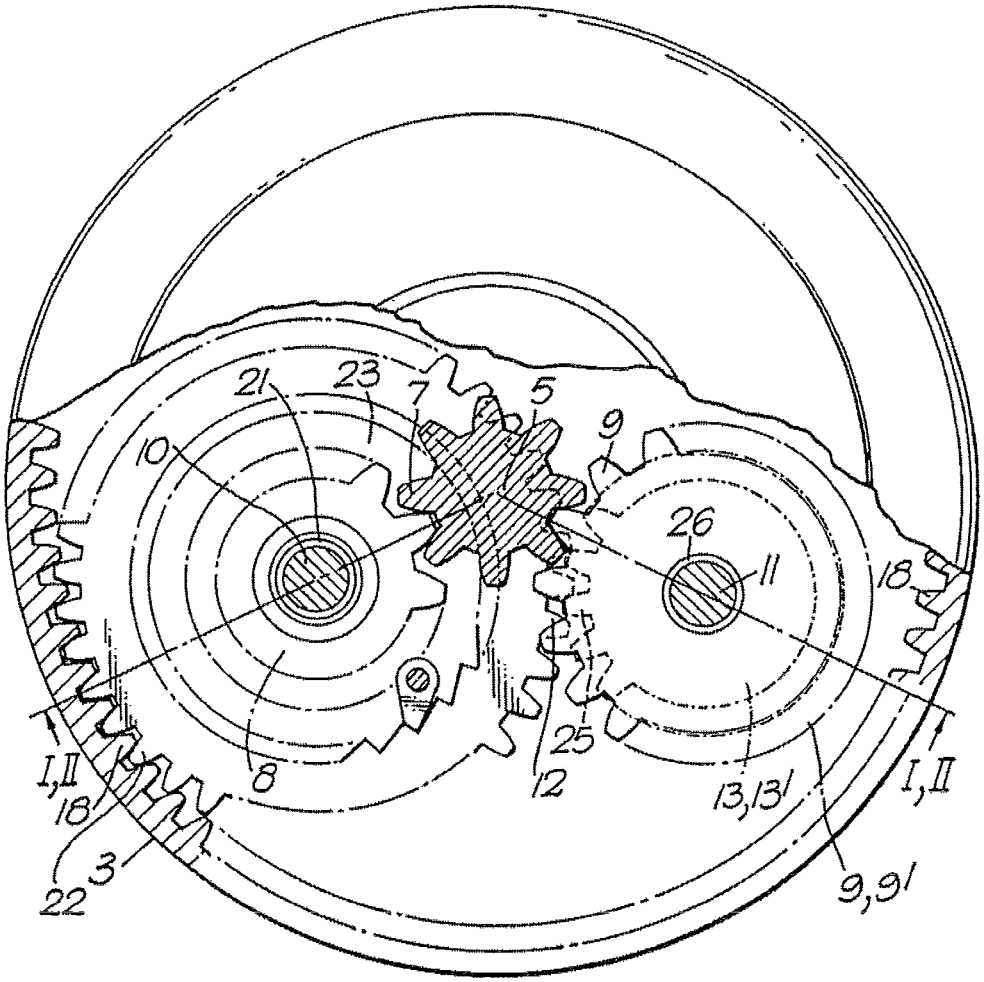
Fig. 3 PRIOR ART
FIG. 3 shows a partial sectional view of the winches of FIGS. 1 and 2 taken along a plane perpendicular to the winch axis.

In order to assist with an understanding of the preferred embodiments of the present invention, it is of assistance first to consider the mechanical arrangement of a fully manual two speed winch. Such a winch is disclosed in U.S. Pat. No. 4,892,291. FIGS. 1, 2 and 3 of U.S. Pat. No. 4,892,291 are reproduced in the drawings of the present disclosure.

FIG. 1 shows a self-tailing winch 1 with a rope guide channel 2 and winch drum 3 borne on a stationary column 4 and driven by a central input drive shaft (manual drive spindle) 5 through a two-speed gear train seen in the lower part of the winch and mounted on its base 6. The self-tailing arrangements and the means by which the drum is supported on the column are not described here in detail. The winch is of a type wherein the drum is driven in one direction at successively different speed ratios automatically by reversal of the input drive shaft 5. Drive is communicated from that shaft via gear teeth 7 (formed by axial grooves formed into the diameter of the shaft 5 at its lower end) and each permanently meshing with a gear of both of the drive trains, which include respectively a first ratchet gear 8,12 (first unidirectional drive means) and a second ratchet gear 9,13 (second unidirectional drive means). The first ratchet gear is mounted on axle 10 and the second ratchet gear on shaft 11. The first ratchet gear has a first part 12 and the second ratchet gear 9 also has a first part 13, gear teeth on the outside of the parts 12,13 being in permanent meshing engagement with each other, the angular arrangement of axles 10,11 being seen more clearly in FIG. 3. The second part 8 of the first gear and second part 9 of the second gear both mesh with the teeth 7 on the shaft. The parts 9,13 and 8,12 respectively have unidirectional coupling between them which are formed by a ratchet track 14,15 on the parts 12,13, and pawls 16,17 on the parts 8 and 9. These are set to drive in respectively opposite senses of rotation and the arrangement is such that when the input drive shaft 5 is first turned in an anti-clockwise direction (a keyed crank handle (not shown) being fitted in the socket in the head of the shaft for this purpose) drive is transmitted from the teeth 7 on the shaft to gear part 8 which through its pawl 16 and ratchet track 14 drives the gear part 12 which is permanently meshed with an internal gear track 18 on the inside of the base of the drum 3. The shaft also rotates the gear part 9 clockwise but the pawls and ratchets 15,17 being oppositely set no drive is transmitted to the gear part 13 which is therefore free to rotate, being driven by the part 12. Whenever the shaft 5 is rotated clockwise, the drive is taken up through the pawl 17 and the ratchet track 15 to the gear part 13, which, meshing with the gear part 12 of the other ratchet gear causes drive to be transmitted through that to the gear track 18 in the drum. At this stage ratchets and pawls 14,16 are not transmitting drive and are clicking past each other, and gear parts 8,12 are counter-rotating.

The construction of both the ratchet gears is designed to minimise eccentricity and friction particularly when not transmitting drive through their own pawl and ratchet drives.

The first gear is made up of parts 8 and 12 the part 12 which provides the track of teeth has a hub with a central sleeve 20 borne through either a solid or a rolling bearing 21 on the surface of the axle 10. A flange then extends to the skirt 22 forming the outer periphery of this ratchet gear part and on the outer face of which are formed the gear teeth. On its peripheral inner face are formed the ratchets of the ratchet track 14. The other part 8 of this gear has also a sleeve within its gear track and this is mounted directly on the outer periphery of the sleeve 20 and is rotatable about it. A somewhat larger diameter sleeve projects downwardly at 23 into the recess formed between the sleeve 20 and the outer peripheral skirt 22 of the first gear part. Spring loaded pawls 16 are mounted on this downwardly projected part 23 for engagement with the ratchet track 14 upon appropriate drive of the two parts.

It can be seen that eccentric loads on the gear part 12 are taken directly onto the shaft 10, something which is particularly important when the gear part 12 is being used to transmit drive from gear part 13 to the drum and when the pawls and ratchets 14,16 are clicking past each other. The rotational bearing surface is at a low radius from the centre of rotation and there is little or no bearing load, in this condition, on the part 8, all of which adds considerably to the efficiency and lack of drag of the winch in that state.

The gear made up of gear parts 9,13 has gear part 13 being borne directly on its shaft 11 and providing an outer peripheral skirt 25 upon the outer periphery of which the gears are formed and on the inner periphery of which is seen the ratchet track 15. The gear part 9 is journalled on the shaft 11 through a sleeve or rolling contact bearing 26 and offers a downwardly projecting sleeve part 27 within which are pivotally housed the pawls 17. Again it can be seen that the two parts of the ratchet gear are rendered independent of each other in the sense of one not having to bear any eccentric load exerted on the other.

FIG. 2 shows a simple non-self-tailing winch. In this case the central shaft referred to as 5 once more has gear teeth 7 which engages on the one hand with a gear part 8 of a first ratchet gear 8,12 indistinguishable in construction and function, to that described with respect to FIG. 1.

The outer gear with which the teeth 7 mesh and which is mounted on an axle 11 as before shows however how the positioning and journaling of the two gear parts may be in effect inverted. The gear part here referred to as 9' although functionally identical to the gear part 9 of the winch of FIG. 1 has a conformation virtually identical to that of gear part 13 of the first embodiment, while the gear part here referred to as 13' has a conformation in function virtually identical with that of gear part 9 of the winch of FIG. 1. The functioning of the winch of FIG. 2 is exactly the same in terms of its drive trains as that of FIG. 1. It is noted that different unidirectional links between the parts of the drive trains can be used to replace the ratchet and pawl mechanisms, e.g. camming roller or rocker catch arrangements can be used.

Known winches provide a development of the type of winch illustrated in FIGS. 1-3, in terms of providing motorised operation in addition to manual operation. Such winches provide a motor driving a motor gear shaft (not shown in FIGS. 1-3) via a worm gear mechanism. Taking the winch of FIG. 2 as an example, manual turning of the manual drive spindle 5 clockwise (CW) (as viewed in FIG. 3) turns gear 8 anticlockwise (ACW) and gear 9 anticlockwise (ACW). Gear 8 freewheels inside its ratchet track and so the first drive train does not drive the winch drum. On the other hand, in the second drive train, gear 9 turning ACW engages its ratchet track, turning gear 13' ACW. This turns gear 12 (the main drive gear) CW which drive the winch drum CW. Gear 12 can turn CW relative to gear 8 due to freewheeling of the ratchet track with respect to gear 8. As will be apparent, manual turning of the manual drive spindle 5 ACW has the effect of allowing the second gear train to freewheel but driving rotation of the winch drum CW at a different gearing ratio via the first drive train. In motorised operation, the motor gear shaft may be linked into the first or second drive trains. Preferably the motor gear shaft is linked into the second drive train for its additional mechanical advantage. Thus, again taking FIG. 2 as an example, gear 13' is driven by the motor gear shaft. ACW rotation of gear 13' by the motor drive shaft turns main drive gear 12 CW and so the winch drum CW. This is allowed by gear 13' being allowed to freewheel inside ratchet track 9. However, any attempt to turn gear 13' CW by the motor gear shaft is impossible because CW rotation of gear 13' would be coupled to gear 9' by the ratchet, but gear 9 is prevented from CW rotation by engagement with manual drive spindle 5 which cannot be driven ACW by gear 9' because this would in turn drive gear 8 CW which is prevented by the combination of the ratchet track inside gear 8 and main drive gear 12 engaging directly with gear 13'. Thus, reverse winding of the winch using the motor (or via manual power) is prevented.

FIGS. 4-12 illustrate a preferred embodiment of the invention. This can be described generally first with reference to FIG. 17. Winch 200 has a winch drum 202 rotatable about a principal axis with respect to a support (not shown in FIG. 17). Winch drum 202 has a rope-receiving surface of frusto-conical shape, the diameter of the rope-receiving surface increasing with axial height up the rope-receiving surface in a known way in order to ensure that the most heavily-loaded turn of rope is located towards the base of the rope-receiving surface. A skirt portion 204 of the winch is formed towards the base of the winch. The winch is mounted on a base support 206 which is fixed with respect to a deck (not shown) of a sailboat (not shown). Base support 206 is connected to a motor gear shaft housing 208 which in turn is connected to motor worm gear housing 210 which houses a worm gear arrangement to be driven by a drive shaft (not shown in FIG. 17) of motor 212. Motor 212 and motor worm gear housing 210 are of known configuration (e.g. from the EVO™ winch of Lewmar Limited) and are not described further here.

Figure 18:
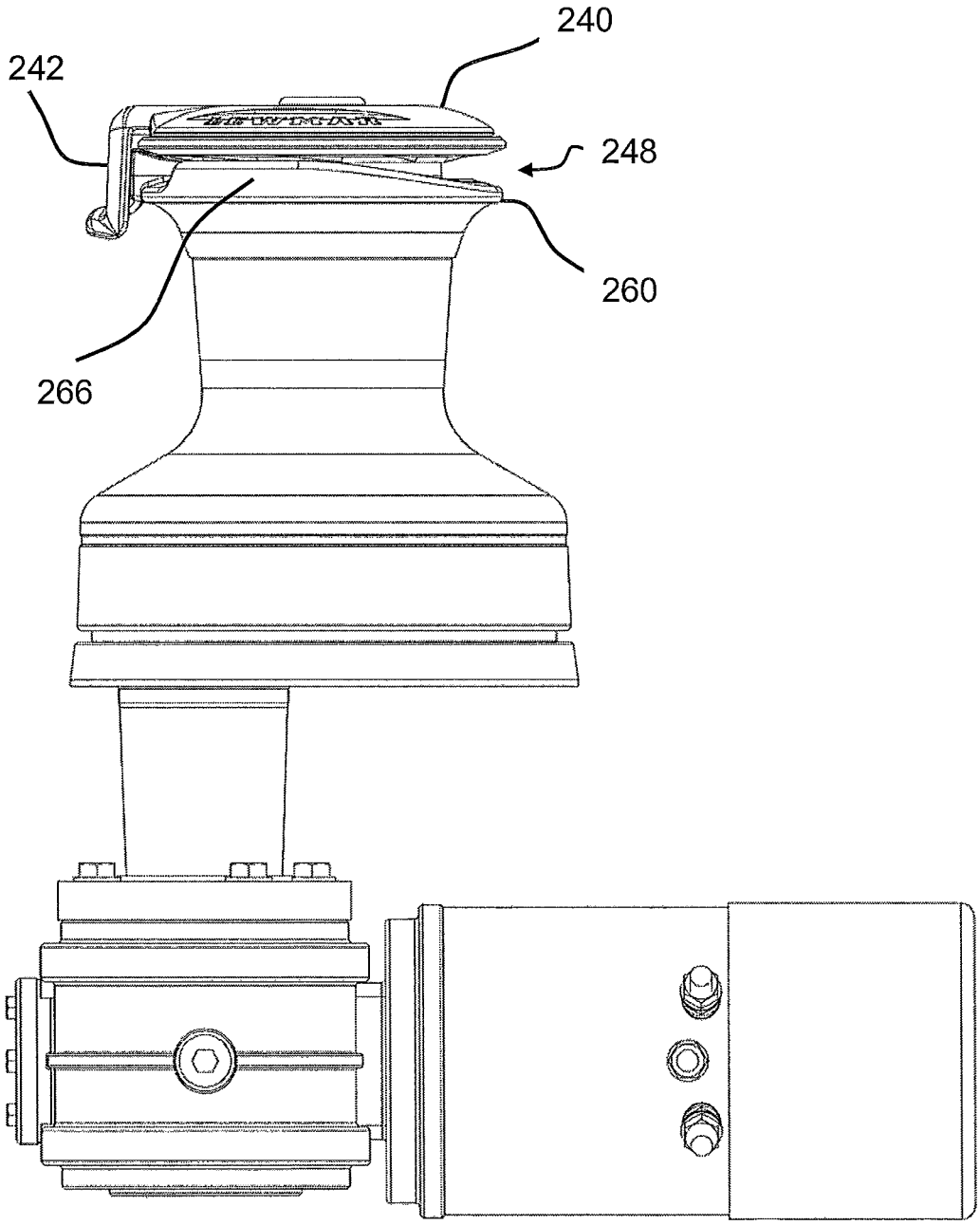
FIG. 18 shows a side view of the winch of FIG. 17.
Figure 19:
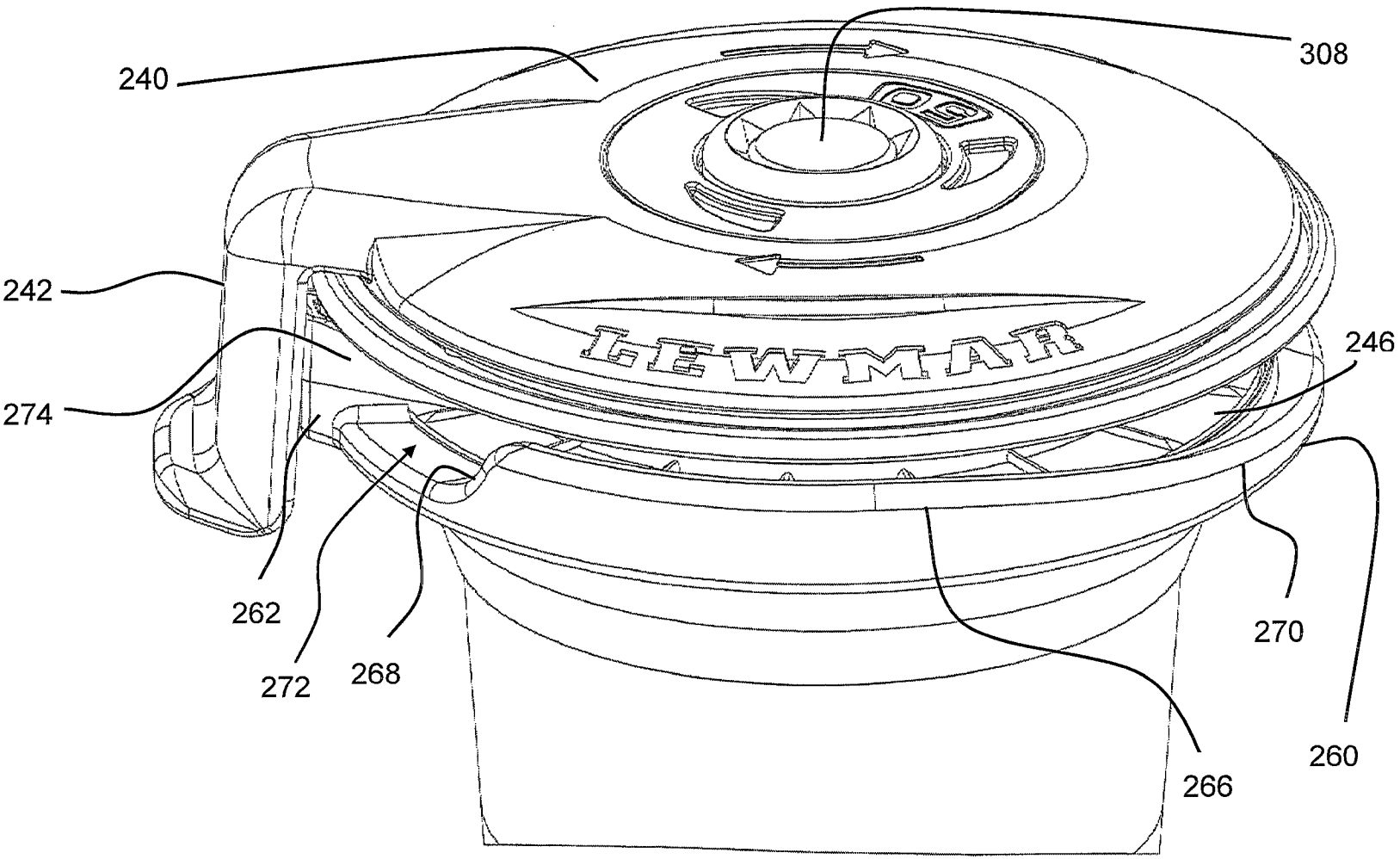
FIG. 19 shows an enlarged perspective view of the self-tailing arrangement of the winch of FIG. 17.

At the upper axial extent of the winch is self-tailing arrangement 220 which will be described later with respect to FIGS. 18-20.

Figure 4:
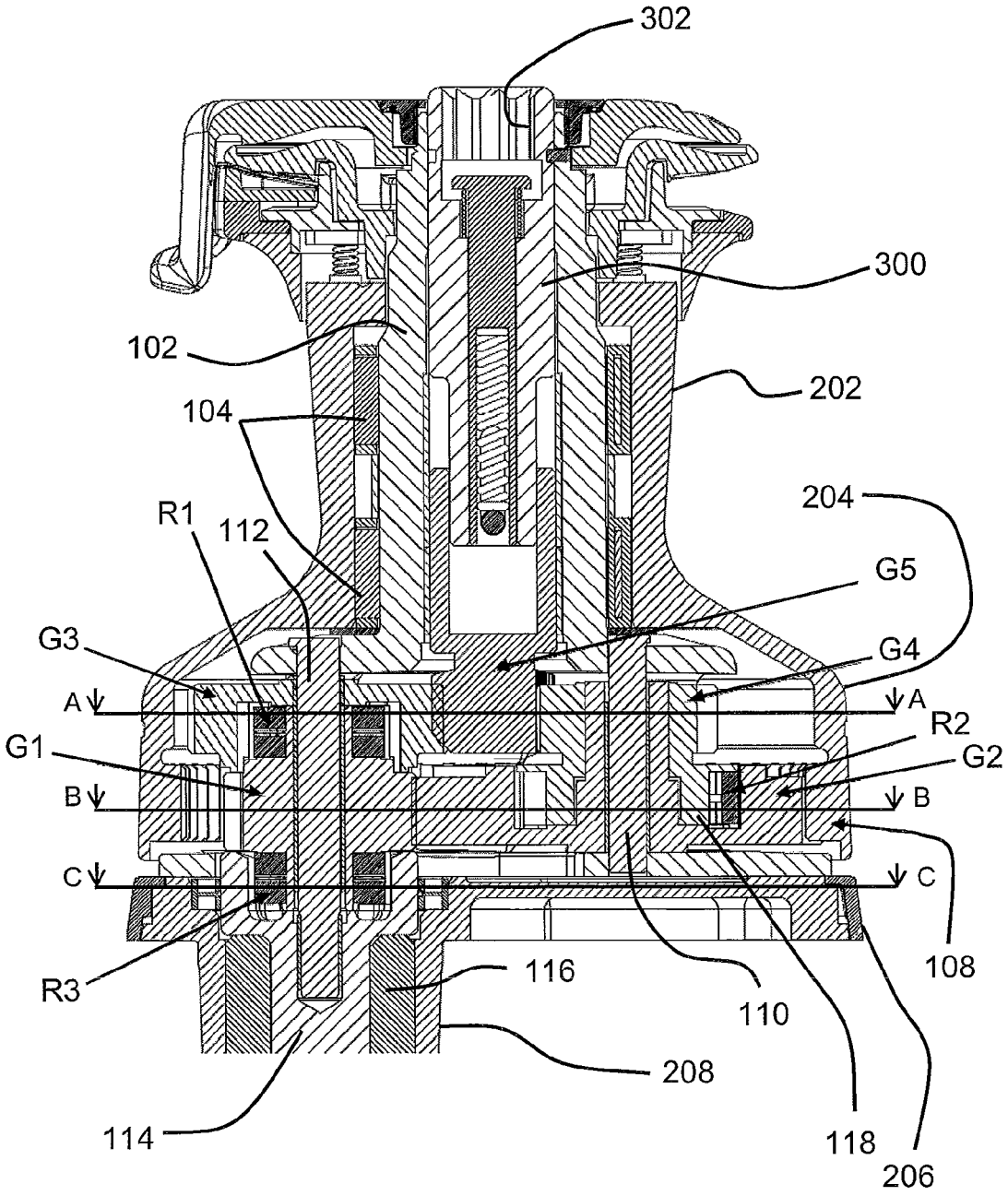
FIG. 4 shows an axial sectional view of a winch according to a preferred embodiment of the invention in manual operation mode.
Figure 17:
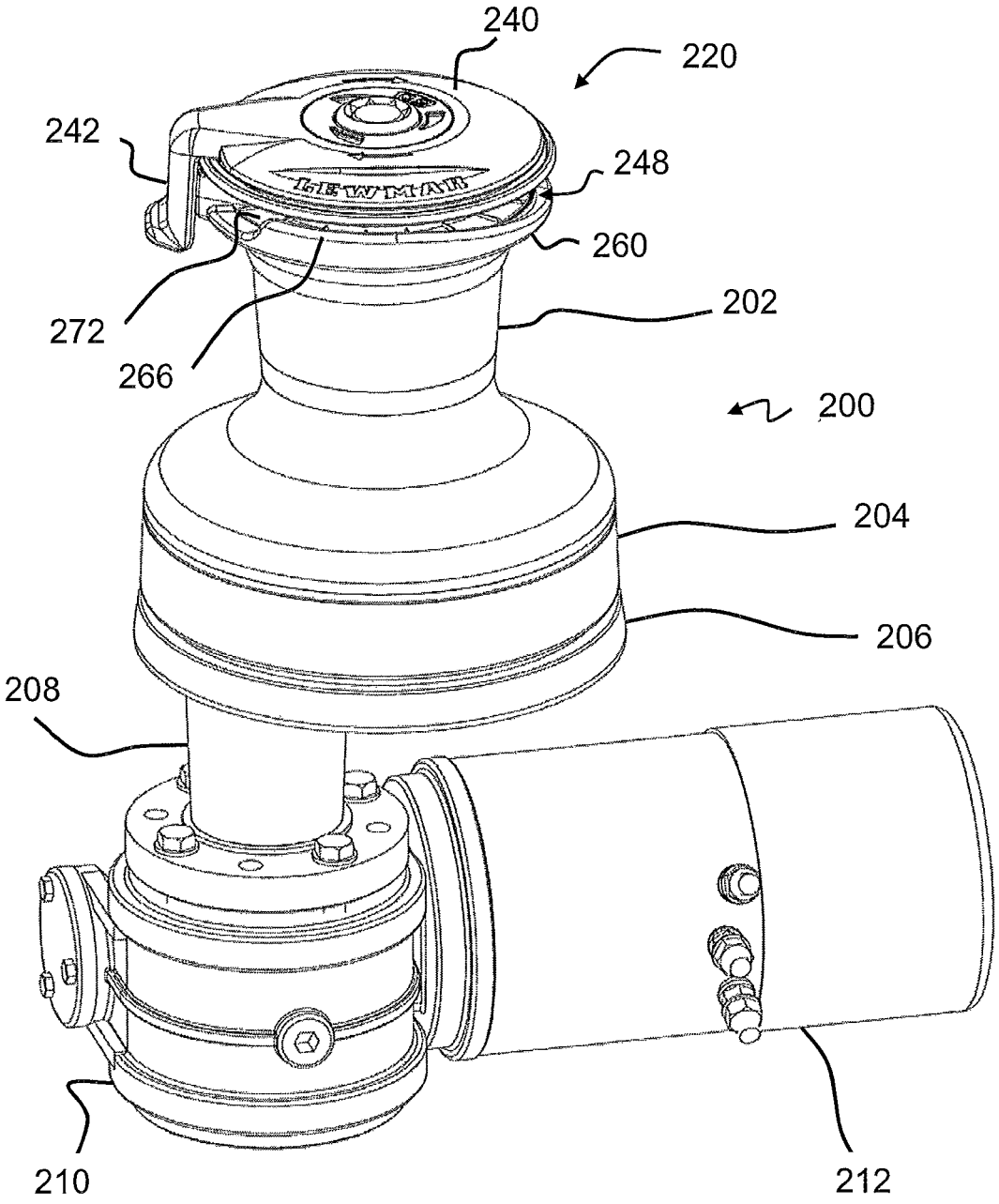
FIG. 17 shows a perspective view of a motorised winch according to a preferred embodiment of the invention.

Turning now to FIG. 4, winch drum 202, skirt portion 204, base support 206 and motor gear shaft housing 208 are given the same reference numbers as in FIG. 17 and their general configuration will not be describe further here. Winch drum 202 is rotatable with respect to support 102 via roller bearings 104. Support 102 is fixed with respect to base 206 which in turn is for fixing with respect to the deck of a sailboat (not shown). Winch drum 202 has a ring gear (drum gear) 108 formed on the inner surface of skirt portion 204.

First axle 110 and second axle 112 respectively locate the first and second drive trains of the winch, described in more detail below. As will be seen, the general layout of the first and second drive trains in respect of manual operation of the winch is similar to than seen in FIGS. 1-3.

Manual drive spindle 300, which will be described in more detail with respect to FIGS. 13-16, has a drive socket 302 formed at its upper end for driving engagement with a keyed (typically bisquare) protrusion extending from a manual cranking handle (not shown).

Motor gear shaft 114 is coaxial with a rotatable relative to second axle 112. Motor gear shaft 114 is held within motor gear shaft housing 208 and is rotatable relative to motor gear shaft housing 208 via bearing 116. In operation, motor gear shaft 114 is driven by a worm gear (not shown). Due to the gearing reduction provided by the worm gear, it is impossible to turn the motor gear shaft 114 unless the motor is operating. Therefore, with the motor inactive, motor gear shaft 114 is locked against rotation.

Main drive gear G2 meshes with ring gear 108. At the interior of main drive gear G2 is formed ratchet track R2 within which turns a pawl carrier 118 carrying sprung pawls 120. Pawl carrier 118 and pawls 120 are able to rotate ACW with respect to ratchet track R2. Pawl carrier 118 is formed integrally with gear G4 which, in the configuration shown in FIGS. 4-7, is engaged with spindle gear wheel G5. Spindle gear wheel G5 is held for rotation with spindle 300. Together, gear G4, pawl carrier 118, pawls 120, ratchet track R2 and main drive gear G2 constitute the first drive train. Pawl carrier 118, pawls 120 and ratchet track R2 together constitute the first unidirectional drive means.

Motor gear shaft 114, at the end distal from the motor gearbox 210, splays to provide an annular shape having ratchet track R3 formed at the inwards facing part of the annular shape. Located within the annular shape is pawl carrier 122, carrying sprung pawls 124. Pawl carrier 122 and pawls 124 are able to rotate ACW with respect to ratchet track R3. Pawl carrier 122, pawls 124 and ratchet track R3 together constitute the third unidirectional drive means.

Pawl carrier 122 is formed integrally with gear G1 which is permanently engaged with main drive gear G2. Gear G1 is also formed integrally with pawl carrier 126 carrying sprung pawls 128. Pawl carrier 126 and sprung pawls 128 are able to rotate ACW with respect to ratchet track R1 which is formed within gear G3. Gear G3 is engaged with spindle gear wheel G5.

Pawl carrier 126, pawls 128 and ratchet track R1 constitute the second unidirectional drive means. Together, gear G3, pawl carrier 126, pawls 128, ratchet track R1, gear G1 and main drive gear G2 constitute the second drive train. The reduction gearing ratio provided by the second drive train is greater than that provided by the first drive train.

Figure 5:
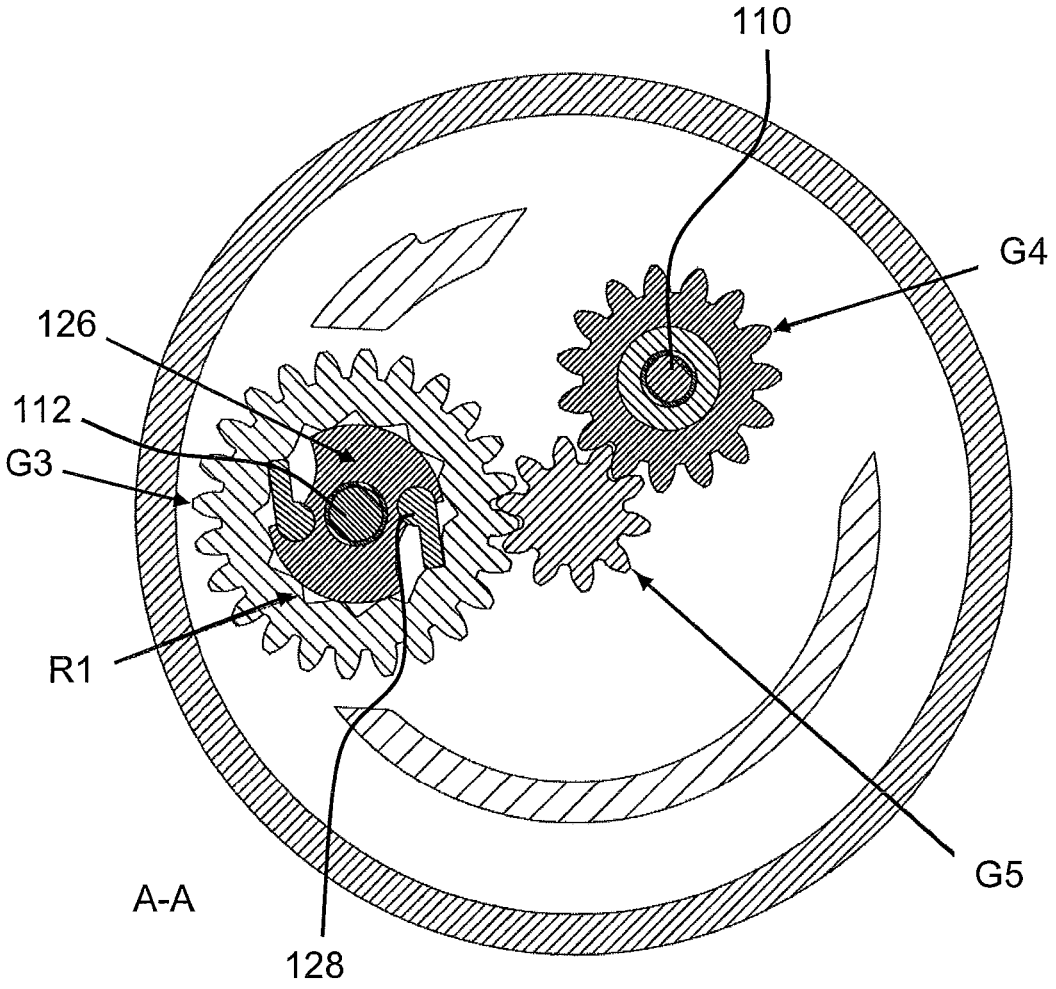
FIG. 5 shows a sectional view of the winch of FIG. 4 taken along A-A.
Figure 6:
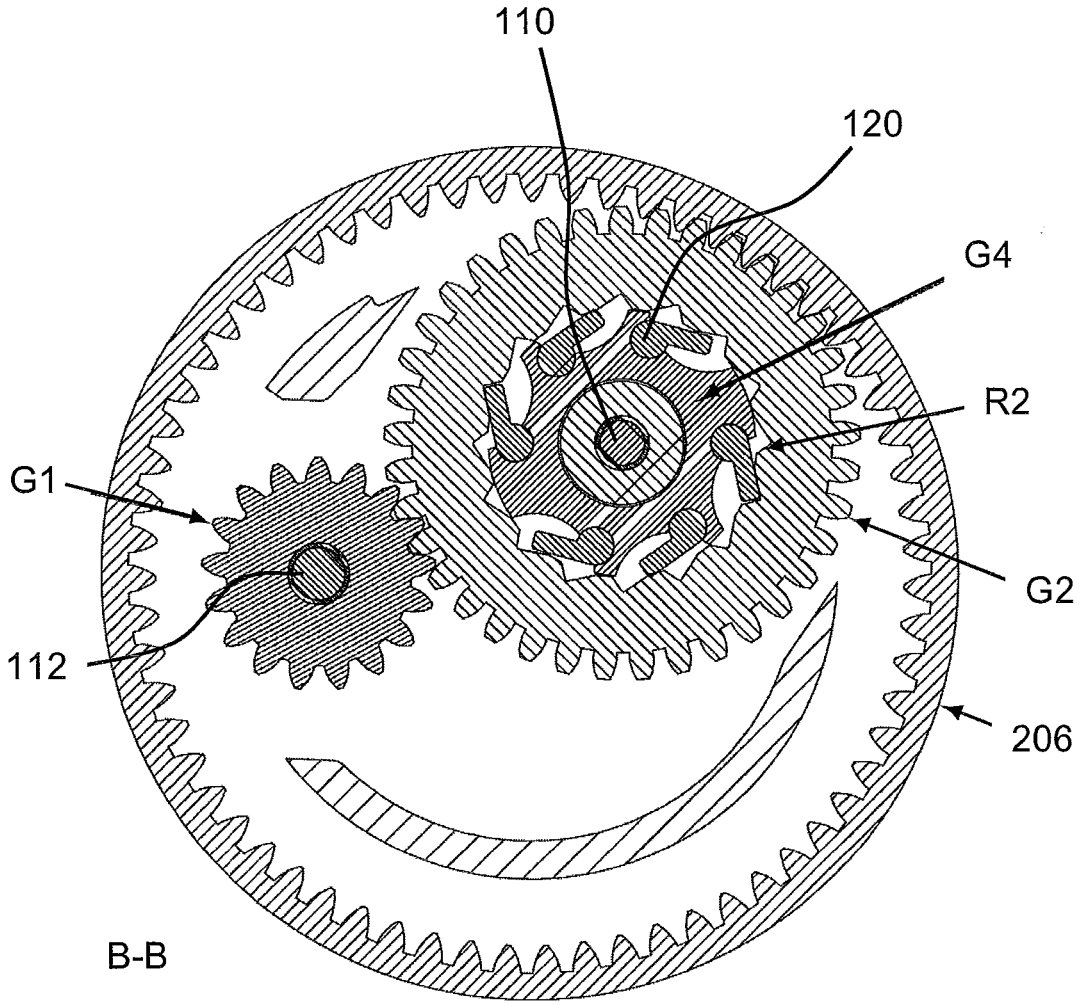
FIG. 6 shows a sectional view of the winch of FIG. 4 taken along B-B.
Figure 7:
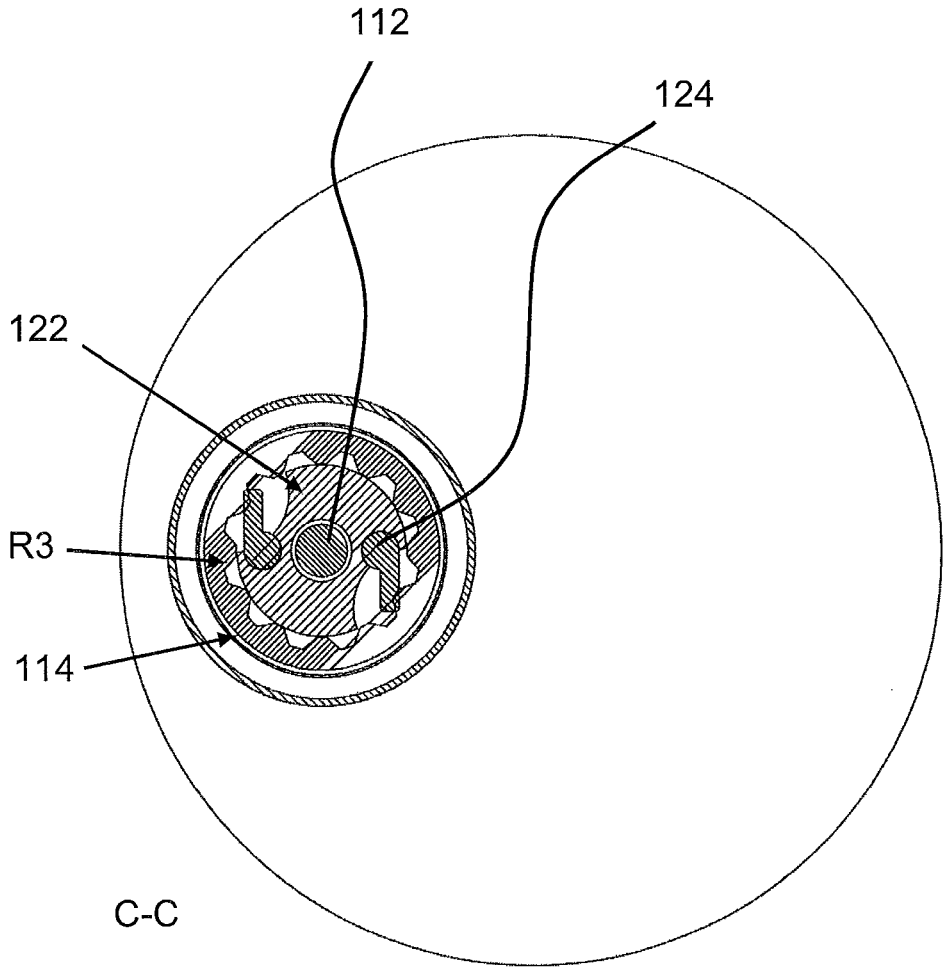
FIG. 7 shows a sectional view of the winch of FIG. 4 taken along C-C.

FIGS. 5, 6 and 7 assist in understanding the configuration shown in FIG. 4 by illustration plan sectional views along A-A, B-B and C-C respectively. The configuration of FIG. 4 has spindle gear wheel G5 in engagement with gears G4 and G3.

Summarising the modes of operation of the first, second and third unidirectional drive means:

First Unidirectional Drive Means Operation:

When gear G4 is turned ACW, gear G2 can idle.

When gear G4 is turned CW, gear G2 will also be turned CW.

When gear G2 is turned CW, gear G4 can idle.

When gear G2 is turned ACW, gear G4 will also be turned CW.

Second Unidirectional Drive Means Operation:

When gear G1 is turned ACW, gear G3 can idle.

When gear G1 is turned CW, gear G3 will also be turned CW.

When gear G3 is turned CW, gear G1 can idle.

When gear G3 is turned ACW, gear 01 will also be turned ACW.

Third Unidirectional Drive Means Operation:

When motor gear shaft 114 is turned CW, gear G1 can idle.

When motor gear shaft 114 is turned ACW, gear G1 will also be turned ACW.

When gear G1 is turned ACW, motor gear shaft 114 can idle.

When gear G1 is turned CW, motor gear shaft 114 will also be turned CW.

In manual operation, with the winch handle driving rotation of the manual drive spindle 300 ACW, gear G5 is turned ACW, this turns gear G4 CW and by driving through ratchet track R2 turns main drive gear G2 CW, this turns the winch drum CW. Gear G5 also turns gear G3 CW and gear G2 turns gear G1 ACW, these two gears can turn in these opposite directions because ratchet track R1 allows this.

Still in manual operation, the manual drive spindle rotation direction may be changed to CW. Gear G5 is turned CW, this turns gear G3 ACW and by driving through ratchet track R1 turns gear G1 ACW, this turns gear G2 CW and therefore also turns the winch drum CW. Gear G5 also turns gear G4 ACW, gear G2 is already being turned CW. These two gears can turn in these opposite directions because ratchet track R2 allows this.

Still in manual operation, gear G5 remains meshed with gears G4 and G3. The winch drum has an ACW torque applied by the tangential rope load. This attempts to turn gear G2 ACW, which attempts to drive through ratchet track R2 and attempts to turn gear G4 ACW. This then attempts to turn gear G5 CW. Gear G2 also attempts to turn gear G1 CW, this attempts to drive through ratchet track R1 to attempt to turn gear G3 CW, this then attempts to turn gear G5 ACW. Thus, gear G5 is being turned CW by gear G4 and ACW by gear G3. The result of this is that the whole gear system locks and so the winch drum does not reverse wind (ACW in this embodiment) under the tangential rope load in the manual driving configuration illustrated in FIGS. 4-7.

Note that gear G1 is being turned CW by gear G2, this would drive through ratchet track R3 into motor gear shaft 114. However, due to the number of teeth and therefore the angle before they engage on both ratchet tracks R1 and R2, ratchet track R3 is never engaged in this way.

Now we consider the situation in which the winch is powered by the motor.

Taking the same configuration as shown in FIGS. 4-7, i.e. with gear G5 engaged with gears G3 and G4, motor gear shaft 114 is turned ACW by the motor, this drives through ratchet track R3 and turns gear G1 ACW, this turns gear G2 CW and then this turns the winch drum CW for powered forward winding. Gear G1 is turning ACW which does not drive through ratchet track R1. Gear G2 is turning CW which does not drive through ratchet track R2. Both gear G3 and G4 are not driven and as such neither is gear G5.

Figure 12:
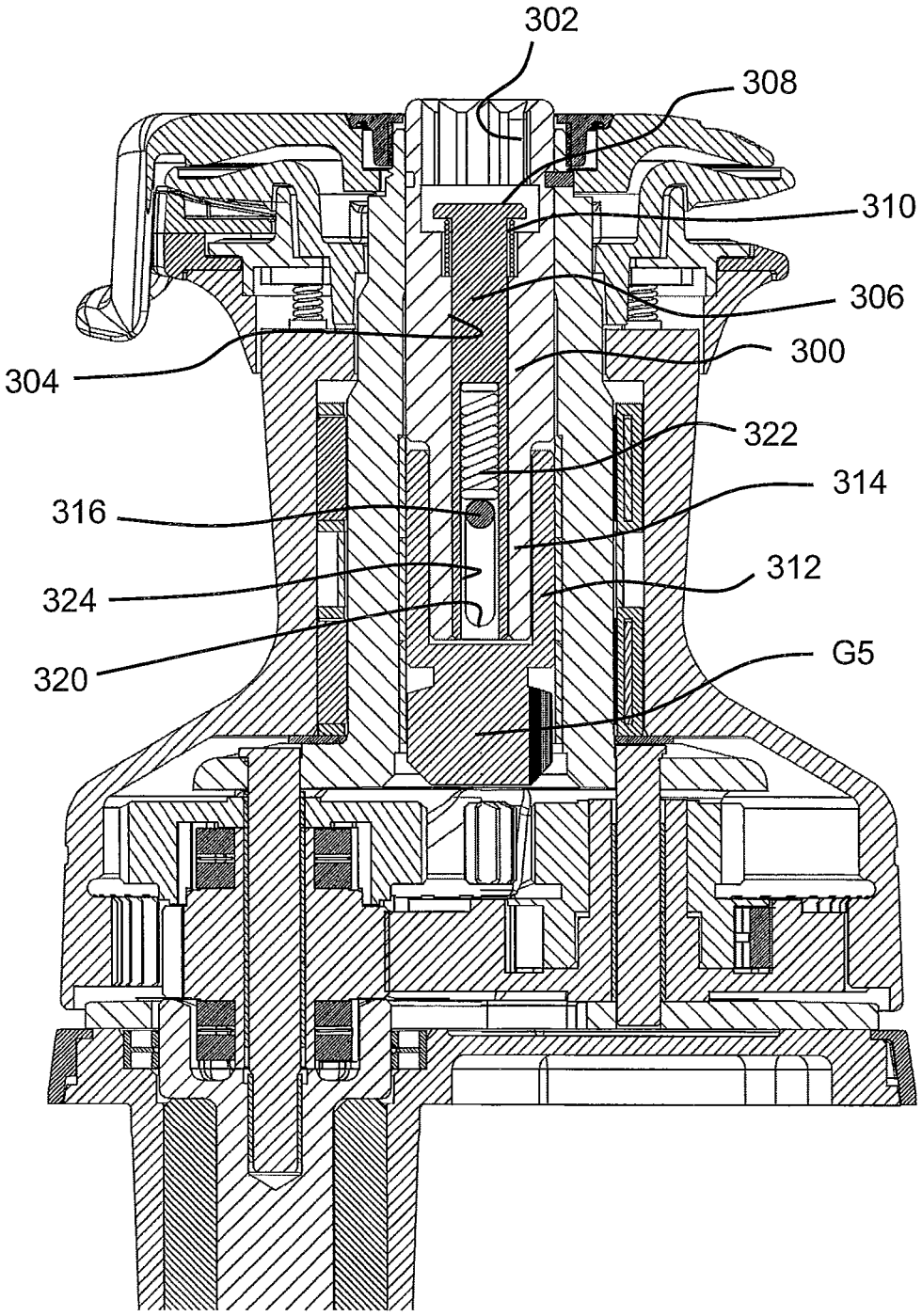
FIG. 12 shows an axial sectional view of the winch of FIG. 4 during conversion from motorised to manual operation mode.
Figure 13:
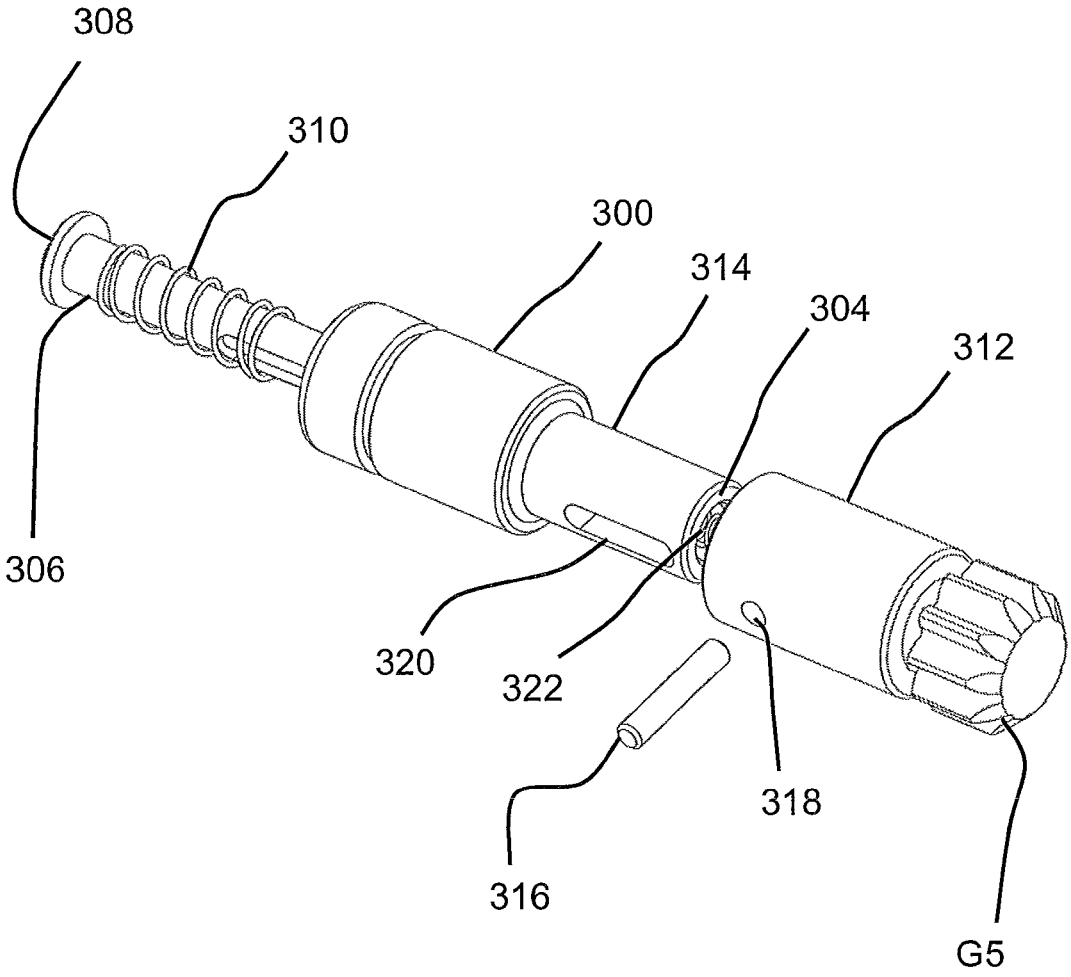
FIG. 13 shows an exploded perspective view of the manual drive spindle for use with the winch of FIG. 4.

Now consider the situation in which spindle gear wheel G5 is taken out of engagement with gears G4 and G3, as shown in FIGS. 8-11 and also in FIG. 12. Note that in these drawings, identical features to FIGS. 4-7 are not described again and are given the same reference numbers.

By removing the spindle gear wheel G5 from the first and second gear train, this then makes gears G3 and G4 no longer part of the system. Note that it may not be essential in all embodiments to take G5 out of engagement with both G3 and G4, but for safety reasons is it preferred to do so.

During powered forward winding of the winch, motor gear shaft 114 is turned ACW by the motor, this drives through ratchet track R3 and turns gear G1 ACW, this turns main drive gear G2 CW and then this turns the winch drum CW. Gear G1 is turning ACW which does not drive through ratchet track R1. Gear G2 is turning CW which does not drive through ratchet track R2. Both gears G3 and G4 are not driven.

Even with spindle gear wheel G5 removed, the winch is locked against reverse winding if the motor is not operated. The winch drum is subjected to an ACW torque by the tangential rope load. This attempts to turn gear G2 ACW and therefore gear G1 CW. This then attempts to drives through ratchet track R3 but as motor gear shaft 114 is locked against rotation by the motor and worm gear, this stops the winch drum rotating. Both gears G3 and G4 are driven via ratchet tracks R1 and R2 but as gear G5 is now removed they play no part in the system.

Figure 8:
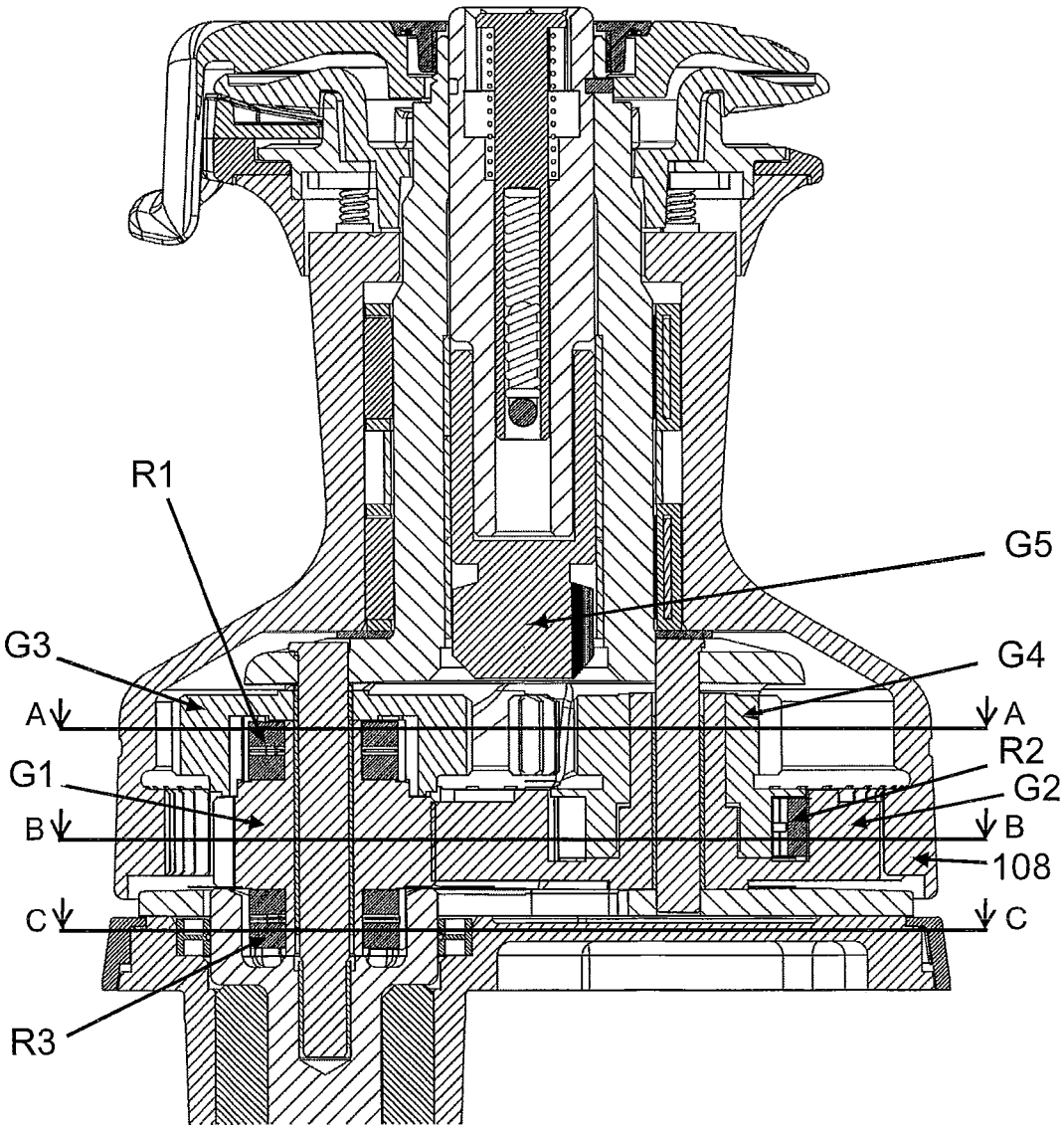
FIG. 8 shows an axial sectional view of a winch of FIG. 4 motor operation mode.
Figure 9:
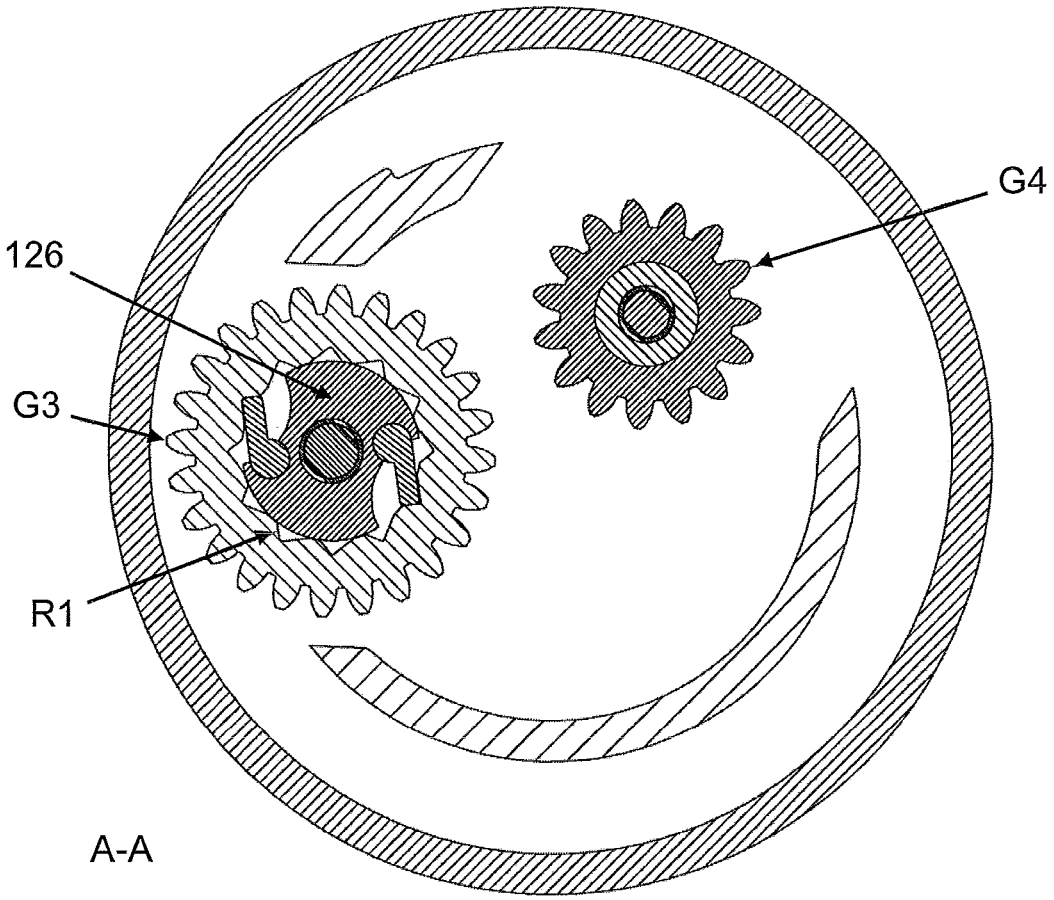
FIG. 9 shows a sectional view of the winch of FIG. 8 taken along A-A.
Figure 10:
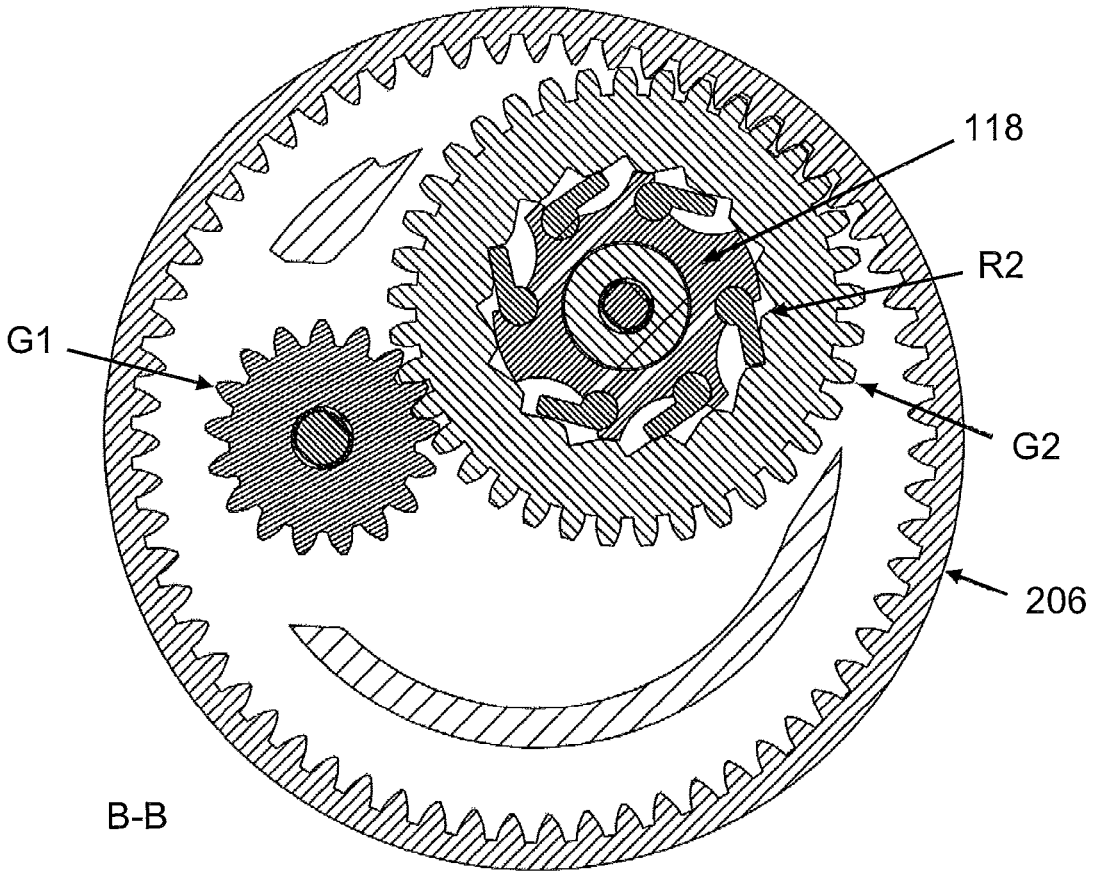
FIG. 10 shows a sectional view of the winch of FIG. 8 taken along B-B.
Figure 11:
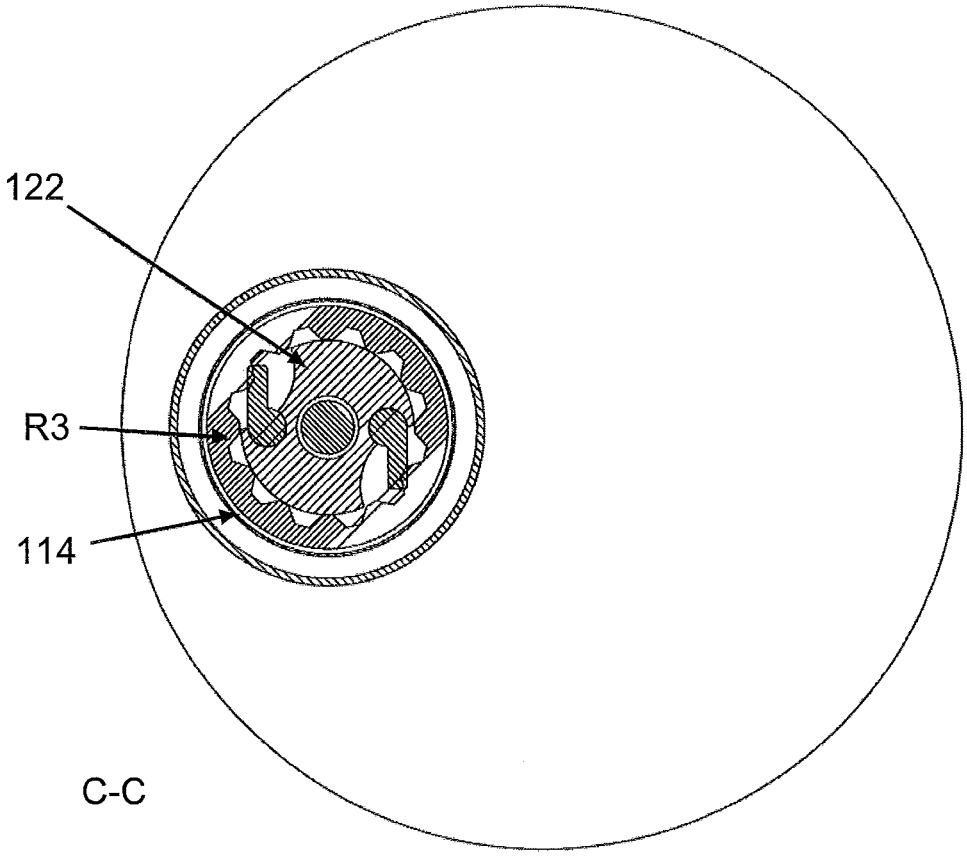
FIG. 11 shows a sectional view of the winch of FIG. 8 taken along C-C.

Now we consider operation of the winch to provide powered reverse winding, with spindle gear wheel G5 removed as shown in FIG. 8. The winch drum is subjected to an ACW torque by the tangential rope load. This turns main drive gear G2 ACW and therefore gear G1 CW. Gear G2 turning clockwise is locked against ratchet track R3. However if ratchet track R3 itself is rotated CW by CW rotation of the motor gear shaft 114 driven by the motor, consequently the winch drum is allowed to rotate ACW (i.e. reverse winding).

Both gears G3 and G4 are driven via ratchet tracks R1 and R2 but as gear G5 is now removed they play no part in the system.

Accordingly, in this preferred embodiment, reverse winding of the drum is powered in effect by the rope load. The speed of rotation is controlled by the speed of the motor, but the motor itself does not drive reverse winding—it instead allows reverse winding to occur by providing rotation of the third unidirectional drive means which otherwise would lock the drum against reverse winding.

With reference to FIGS. 12-16, the way in which spindle gear wheel G5 is brought into and out of engagement with gears G3 and G4 will now be explained in detail.

Manual drive spindle 300 has drive socket 302 formed at its upper end and an axial bore 304 formed through the remainder of its length. Plunger 306 slidingly fits in axial bore 304.

Head 308 of plunger 306 is formed with a flange against which an upper end of spring 310 bears. The lower end of spring 310 bears against a corresponding recess in axial bore 304, with the result that plunger 306 is urged upwardly along axial bore 304. Spindle collar 312 is formed integrally with spindle gear wheel G5 and fits over a corresponding narrowed portion 314 of spindle 300 for sliding axial movement with respect to spindle 300.

Plunger 306 is attached to collar 312 by shear pin 316 extending through radial holes 318 in collar 312, radial slot 320 in narrowed portion 314 and through a corresponding hole (not shown) at the lower end of plunger 306. Spring 322 is held in an axial bore 324 of plunger 306, the spring 322 being held for compression between a blind end of bore 324 and shear pin 316. The urging effect of spring 322 is therefore to slide collar 312 and the integral gear wheel G5 to the lower limit of travel of shear pin 316 in slot 320.

Figure 14:
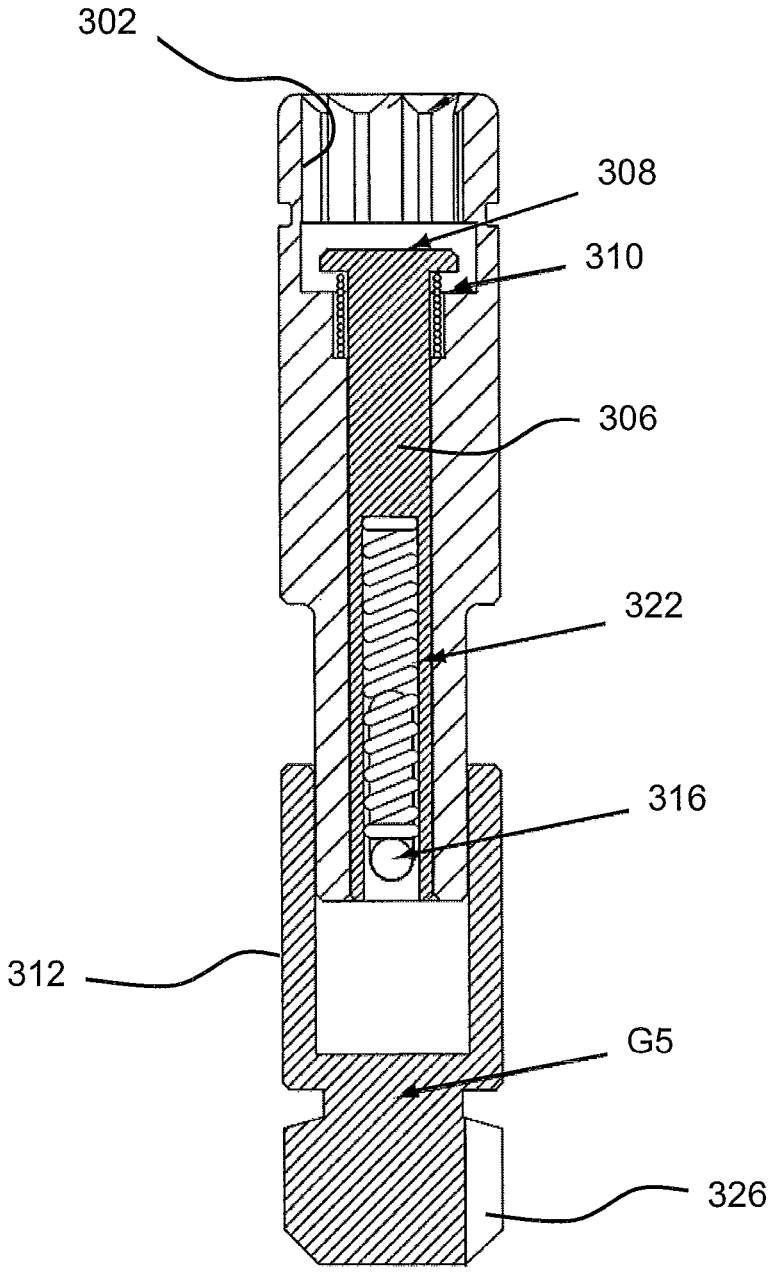
FIG. 14 shows an axial sectional view of the manual drive spindle of FIG. 13 in the winch configuration shown in FIG. 4.
Figure 15:
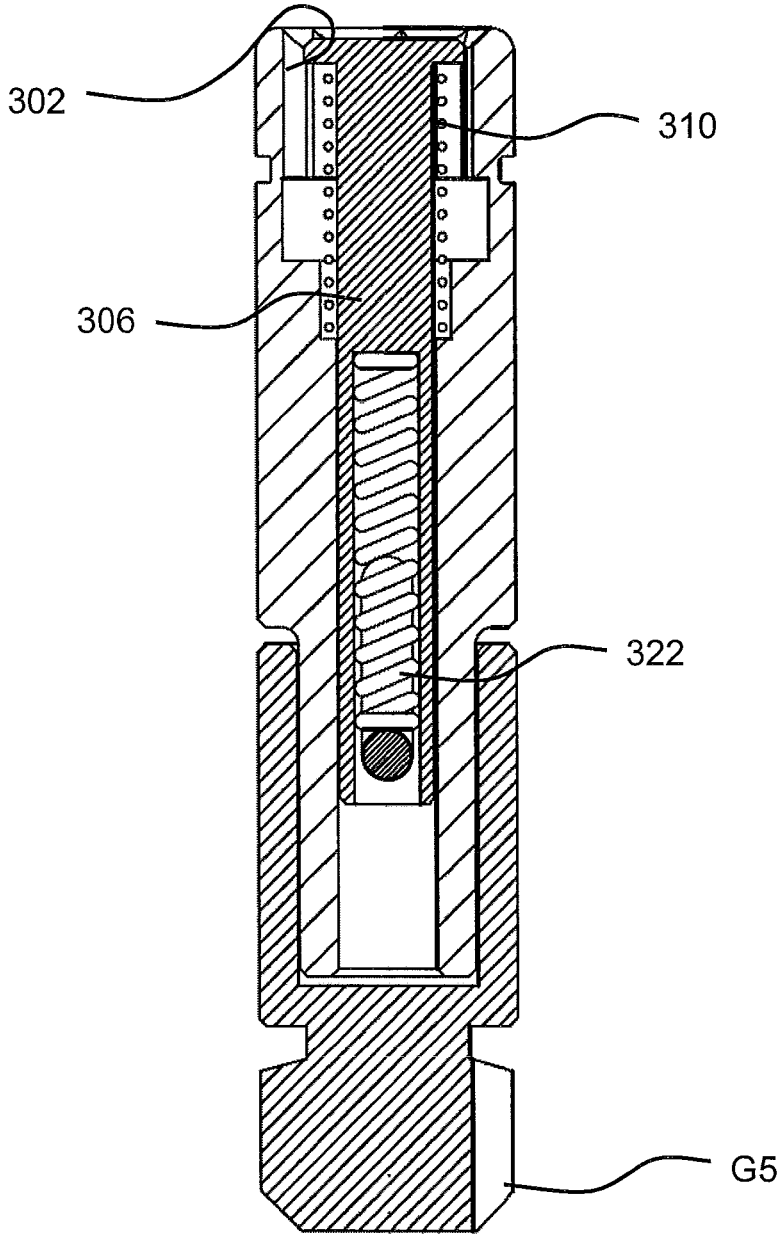
FIG. 15 shows an axial sectional view of the manual drive spindle of FIG. 13 in the winch configuration shown in FIG. 8.
Figure 16:
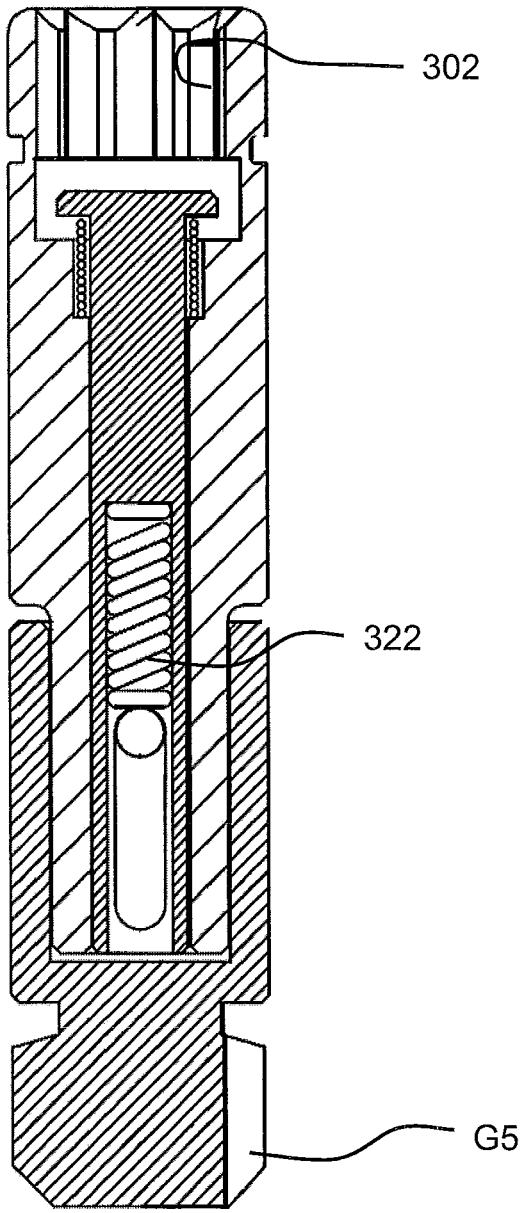
FIG. 16 shows an axial sectional view of the manual drive spindle of FIG. 13 in the winch configuration shown in FIG. 12.

The effect of this is demonstrated in FIGS. 14-16. FIG. 14 illustrates the configuration in which the winch crank handle (not shown) is inserted into the manual drive socket 302 of the manual drive spindle 300. The insertion of the winch handle into drive socket 302 depresses plunger 306 by bearing against head 308 of plunger 306. This compresses spring 310. Downwards axial movement of plunger 306 causes downward axial movement of collar 312 and integral gear wheel G5 due to the urging of spring 322 against shear pin 316. Accordingly, provided that gear wheels G3 and G4 are angularly disposed in order to receive gear G5, gear G5 will engage with gears G3 and G4. It will be seen from FIG. 13 that the lower axial extent of G5 is provided with bevelled gear teeth 326 in order to assist with this engagement between G5, G3 and G4.

FIG. 16 illustrates the configuration in the case where the winch handle is placed in the manual drive socket 302 but where gears G3 and/or G4 are not yet in an angular position to receive gear G5 for engagement. In this case, spring 322 is compressed so that gear G5 is located out of axial engagement with gears G3 and G4. As the winch is operated, there will come a point at which gears G3 and G4 are in an angular position to allow engagement with gear G5, at which point urging of spring 322 will axially extend gear G5 into engagement with gears G3 and G4.

It will be seen that the configuration of the manual drive spindle shown in FIG. 16 corresponds to that shown in FIG. 12 and the configuration shown in FIG. 14 corresponds to that shown in FIG. 4.

FIG. 15 shows the configuration of the manual drive spindle with the winch handle removed from drive socket 302. This is the same as the configuration shown for the winch in FIG. 8. In this configuration, each of springs 310 and 322 urge plunger 306 upwards. The result of this is that gear G5 is retracted from engagement with gears G3 and G4.

FIG. 17 shows a perspective view of a motorised winch according to a preferred embodiment of the present invention. The same winch is shown in side view in FIG. 18, in enlarged perspective view in FIG. 19, in enlarged side view in FIG. 20 and in enlarged sectional view in FIG. 21.

Self-tailing arrangement 220 is provided in order to take rope from the winding surface of winch drum 202 towards an unloaded end of the rope (not shown). Parts of the self-tailing arrangement rotate with the winch drum 202 and parts of the self-tailing arrangement remain stationary with respect to winch support 102. It should be noted that any parts of the self-tailing arrangement which are stated to remain stationary with respect to the support 102 during operation of the winch may be rotationally adjustable with respect to support 102, for example in order to locate the self-tailing arrangement at a convenient position with respect to the operator.

Top cap 240 is arranged to fit at the top of the winch. Top cap 240 remains stationary with respect to winch support 102 during operation of the winch. Feeder arm 242 is provided integrally with top cap 240, in order to guide rope from the winch drum 202 and into the self-tailing arrangement. The self-tailing arrangement further includes upper rope lock ring 244 and lower rope lock ring 246, best seen in FIGS. 20 and 21. Each rope lock ring is provided with knurls, or the like, in order to enhance gripping on rope. Rope lock rings 244, 246 are rotatable with winch drum 202. Together, rope lock rings 244 and 246 define a rope guide channel 248 around the self-tailing arrangement.

Lower rope lock ring 246 is spring mounted with respect to the winch drum 202 via springs 250, 252. Corresponding springs may be provided at suitable angular intervals around the lower rope lock ring 246. Spring mounting of the lower rope lock ring 246 in this way allows the width of the rope guide channel 248 to be varied during operation, in order for the rope guide channel to accommodate ropes of different diameters.

Thus far, the description of the self-tailing arrangement corresponds to the self-tailing arrangement known from winches such as the Lewmar EVO™ winch.

Figure 22:
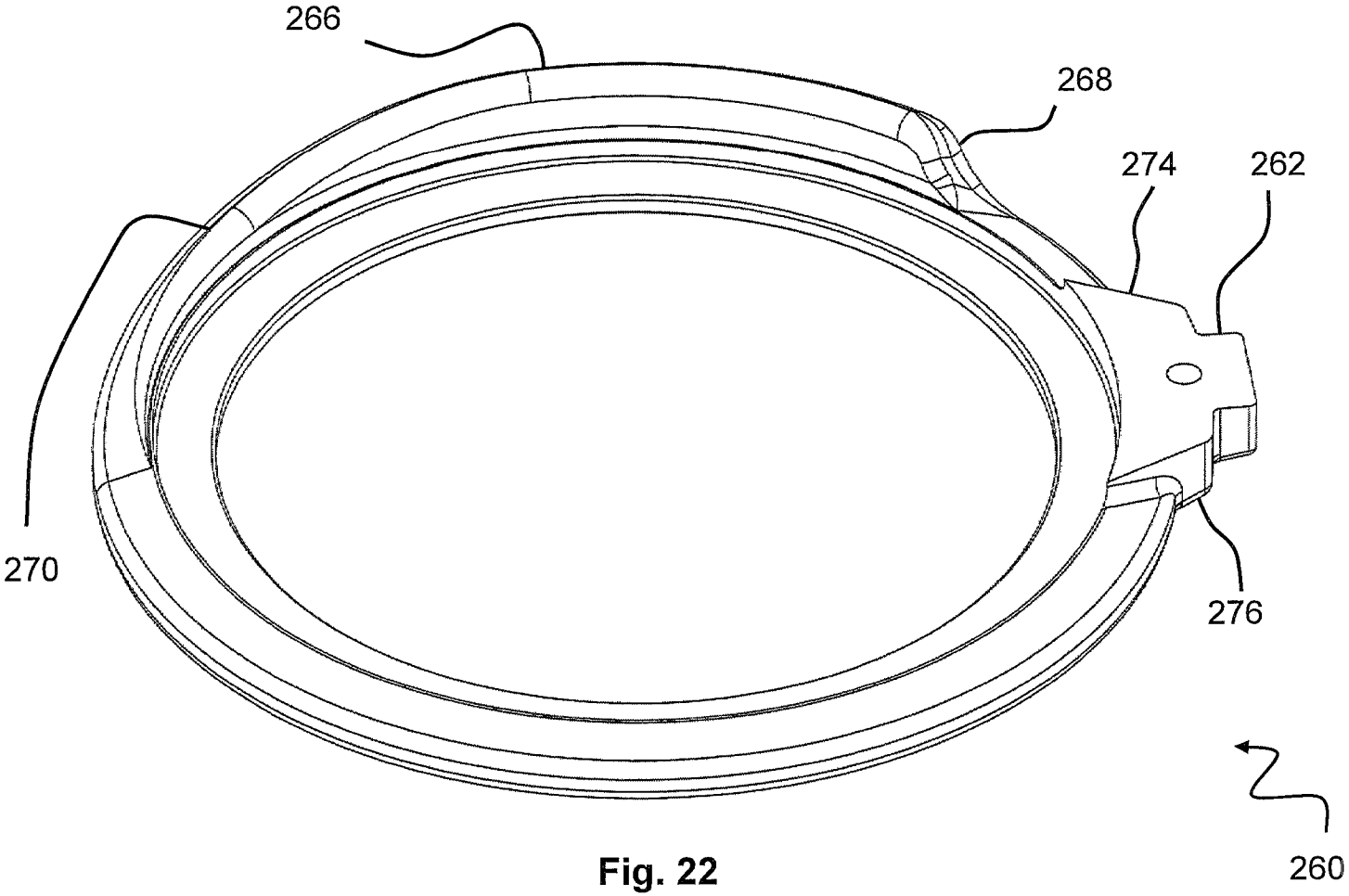
FIG. 22 shown an enlarged perspective view of the retainer guide, separated from the winch of FIG. 17.

However, additionally, the winch according to the preferred embodiment includes a retainer guide 260 in the form of a ring that extends around the full circumference of the self-tailing arrangement, best seen in FIG. 22. Retainer guide 260 includes protrusion 262 which fits into a corresponding axial slot 264 formed on the inward face of feeder arm 242. Protrusion 262 and slot 264 cooperate to prevent rotation of retainer guide 260 with respect to feeder arm 242. However, the axial extendable slot allows retainer guide 260 to move axially to a limited extent with respect to feeder arm 242. The result of this is that, during normal operation of the winch, retainer guide 260 does not rotate with rope lock rings 244 and 246.

FIG. 22 shows a perspective view of retainer guide 260. Retainer guide 260 has a retainer lip 266 extending only partly circumferentially around the self-tailing assembly. The shape of retainer lip 266 when viewed from a radial direction has an asymmetric profile. As shown in FIG. 19, the left hand end of retainer lip 266 has a relatively steep surface and the right hand extent of retainer lip 266 has a relatively shallow tapered surface. The steep surface is a reverse winding guide portion, typically having a steepness of about 60°. In contrast, the shallow tapered portion 270 has a slope of 15° or less, typically about 7.5°. The retainer lip 266 extends for about 120° around the circumference of the self-tailing assembly. Between the feeder arm 242 and the reverse winding guide portion 268 is defined opening 272 which is sized in order to conduct rope out of and into the self-tailing arrangement.

In normal use of the winch during forward winding, rope from the winch drum is fed into the self-tailing arrangement by feeder arm 242 in a clockwise direction. Unloaded rope is ejected from the self-tailing arrangement at opening 272. Rope is encouraged to leave the rope guide channel 248 by extractor wedge 274 in a known manner.

During reverse winding of the winch, it is necessary for rope to be guided into the rope guide channel in order to be gripped by rope lock rings 244 and 246. However, since the rope being received in the rope guide channel 248 is unloaded, there is a significant likelihood that reverse winding of the winch will result in the unloaded rope leaving the self-tailing arrangement, potentially leading to a dangerous situation of uncontrolled rope let-out.

This dangerous situation is prevented by reverse winding guide portion 268 on retainer lip 266 guiding the rope through opening 272 and behind retainer lip 266 in the rope guide channel in order to be safely gripped in the rope guide channel between rope lock rings 244 and 246 around the remainder of the circumference of the self-tailing assembly to the feeder arm. The steepness of the slope of reverse winding guide portion 268 prevents the rope from displacing retainer lip 266 (and hence retainer guide 260) downwards during normal operation. However, the user can extract rope from the rope guide channel by pushing the retainer guide 260 downwards against the urging of springs 250, 252. This can be achieved one-handed if necessary, if the user uses the rope to depress retainer guide 260.

The relatively shallow slope of tapered portion 270 means that, if rope is only partially inserted into the self-tailing arrangement adjacent feeder arm 242 during forward winding of the winch, the rope travelling around the self-tailing arrangement encounters tapered portion 270. Continued forward winding of the winch causes the rope to cam the retainer guide 260 downwards by virtue of the shallow slope of tapered portion 270, until the rope is fully contained in the rope guide channel behind retainer lip 266, the unloaded end of the rope then being fed through opening 272.

Figure 20:
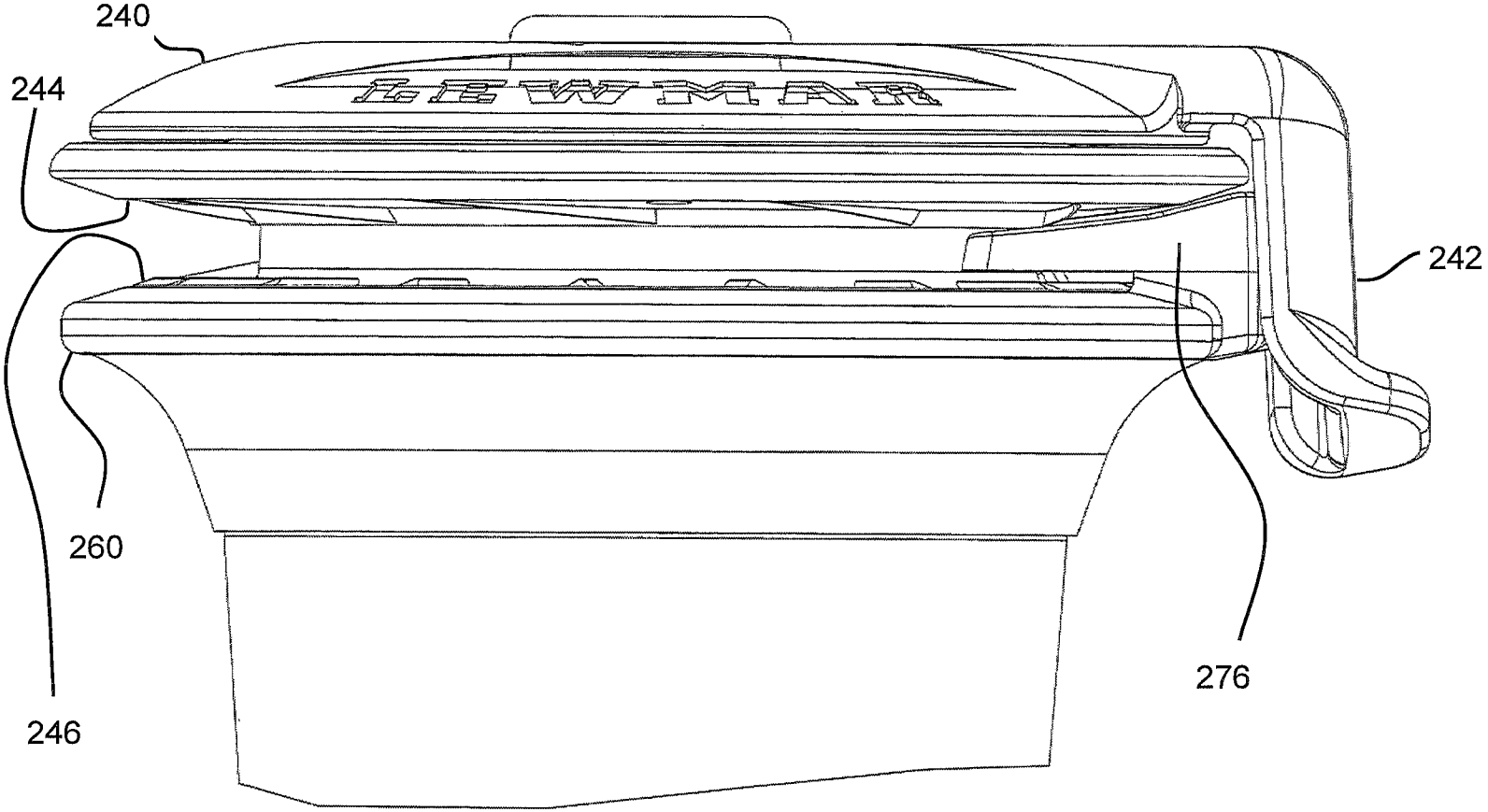
FIG. 20 shows an enlarged side view of the self-tailing arrangement of the winch of FIG. 17.
Figure 21:
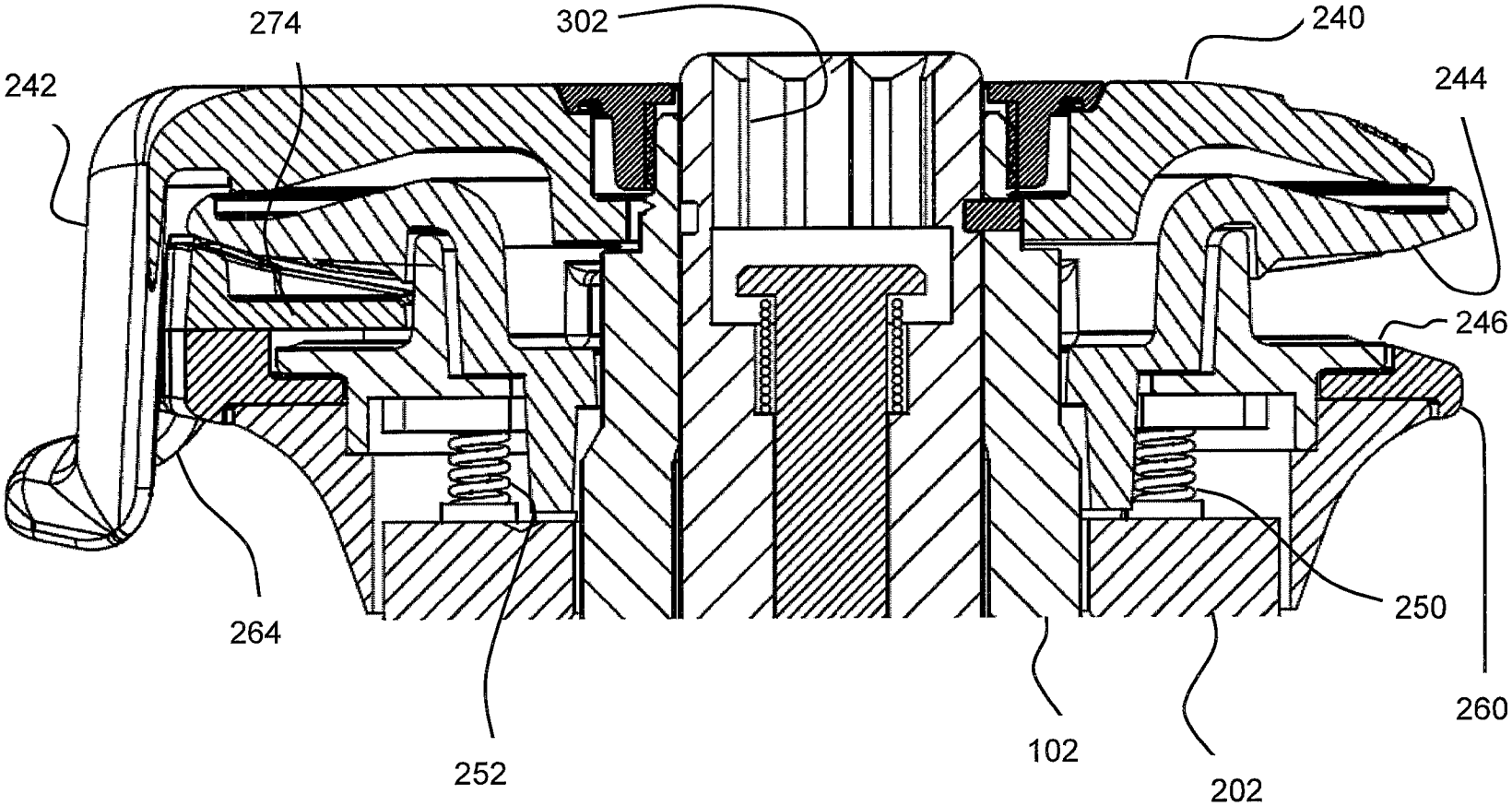
FIG. 21 shows an enlarged axial cross sectional view of the self-tailing arrangement of the winch of FIG. 17, corresponding to the view shown in FIG. 4.

With reference to FIG. 20, during reverse winding, reverse wind extractor 276 assists in the extraction of the rope from the rope guide channel and back onto the feeder arm for feeding to the drum 202. Reverse wind extractor 276 has a similar configuration to forward wind extractor 274, in that it is in the form of a wedge.

As will be understood from the above description of the preferred embodiments of the invention, it is preferred that the winch provides at least two (but preferably only two, for simplicity) manual forward driving speeds, of different gearing ratios. The manual forward gearing ratio is selected according to the direction of rotation of the manual drive socket, and thus the direction of rotation of the winch handle. In view of the manner in which reverse winding is achieved, being controlled (rather than powered) by the motor, reverse winding is typically only provided when rope wrapped around the winch drum is subjected to a load which provides a reverse winding torque to the winch drum. If the motor is turned in the reverse winding direction but there is no reverse winding torque on the winch drum, then the user is given an audible indication that there is no reverse winding of the winch drum by hearing the clicking of the ratchet of the third unidirectional drive means operating in free wheel mode.

When the winch handle is located in the manual drive socket, the winch is locked against reverse winding. In this way, reverse winding is not possible by manual operation or by motor operation. This provides an important safety feature of the preferred embodiments of the present invention. However, when the crank handle is located in the drive socket, the winch is still capable of motor-operated forward winding. However it is important to note that in this situation, motor-operated forward winding of the winch does not rotate the crank handle.

Suitable controls are provided for controlling the motor. In a preferred embodiment, only two selectable on-off controls are provided (these are not illustrated in the drawings). A forwards control button is exclusively for controlling on-off motor-operated forward winding. Thus, there is no other operation possible using this button. Similarly, a reverse control button is provided exclusively for controlling on-off motor-operated reverse winding of the winch drum. There is no other function provided by this button. The importance of this is that, during challenging sailing conditions, the user does not need to toggle a selector switch in order to ensure that the relevant buttons will provide the required mode of operation of the winch.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

We claim:

1. A winch for a sailboat, comprising:

a support for mounting the winch with respect to the sailboat;

a winch drum rotatable with respect to the support;

a ring gear fixed with respect to the winch drum;

a main drive gear meshing with the ring gear for driving rotation of the winch drum;

a manual drive spindle; and a motor gear shaft, wherein the winch is capable of manual operation for forward winding of the winch drum in a first gearing ratio and in a second gearing ratio, the first and second gearing ratios being selected depending on the direction of rotation of the manual drive spindle, the winch further comprising:

a first gear train providing the first gearing ratio, the first gear train having a first unidirectional drive means operable to drive the main drive gear when the first unidirectional drive means is rotated in a forward direction and operable to freewheel when the first unidirectional drive means is rotated in a reverse direction; and a second gear train providing the second gearing ratio, the second gear train having a second unidirectional drive means operable to drive the main drive gear when the second unidirectional drive means is rotated in a reverse direction and operable to freewheel when the second unidirectional drive means is rotated in a forwards direction, the winch further comprising:

a third unidirectional drive means linked to the motor gear shaft, wherein the winch is capable of motorised operation in which the winch drum is operatively linked to the motor gear shaft via the third unidirectional drive means and via at least part of the first or second gear train, and rotation of the third unidirectional drive means by the motor gear shaft in a first direction drives the main drive gear and causes forward winding of the winch drum and rotation of the third unidirectional drive means by the motor gear shaft in a direction opposite the first direction allows reverse winding of the winch drum.

2. The winch according to claim 1, wherein reverse winding of the winch drum occurs only when there is a reverse winding torque on the drum.

3. The A winch according to claim 2, wherein the reverse winding torque is applied by a load on a rope wrapped around the drum.

4. The winch according to claim 1, wherein the third unidirectional drive means has a first part and a second part capable of interacting according to (i) and (ii):

(i) rotation of the first part in said one direction or rotation of the second part in said opposite direction engages the first and second parts to rotate together, and (ii) rotation of the first part in said opposite direction or rotation of the second part in said first direction allows relative rotation of the first and second parts in a freewheel configuration.

5. The winch according to claim 4, wherein, during forward winding of the winch drum, the first and second parts of the third unidirectional drive means are typically engaged to rotate together and, during reverse winding of the winch drum, the first and second parts of the third unidirectional drive means are engaged to rotate together.

6. The winch according to claim 1, wherein, in use, the motor gear shaft is driven by a motor via worm gearing so that the motor gear shaft is rotationally locked when the motor is not operated.

7. The winch according to claim 1, wherein the motor gear shaft is driven by a motor and when the winch is not subjected to a reverse winding torque, reverse operation of the motor results in relative rotation of the first and second parts of the third unidirectional drive means in a freewheel configuration.

8. The winch according to claim 1, wherein the manual drive spindle is provided with a spindle gear wheel which engages with gear wheels of the first and second gear trains simultaneously during manual operation of the winch, reverse winding torque on the winch drum urging the first and second unidirectional drive means so that the spindle gear wheel locks relative rotation of said gear wheels of the first and second gear trains, and thus prevents reverse winding of the winch drum.

9. The winch according to claim 8, wherein the spindle gear wheel is moveable into and out of engagement with at least one of said gear wheels of the first and second gear trains to allow reverse winding of the winch.

10. The winch according to claim 9, wherein the spindle gear wheel is moveable axially along the principal axis of the manual drive spindle.

11. The winch according to claim 10, wherein the manual drive spindle comprises a manual drive socket for receiving a crank handle for manual driving of the winch, and wherein the spindle gear wheel is out of engagement with at least one of said gear wheels when a manual crank handle is not located in the drive socket of the winch.

12. The winch according to claim 10, wherein the manual drive spindle includes a plunger for axial travel along the manual drive spindle, the plunger having spring means for urging the spindle gear wheel towards engagement.

13. A winch for a sailboat, comprising:

a support for mounting the winch with respect to the sailboat;

a winch drum rotatable with respect to the support;

a ring gear fixed with respect to the winch drum;

a main drive gear meshing with the ring gear for driving rotation of the winch drum;

a manual drive spindle; and a motor gear shaft, wherein the winch is capable of manual operation for forward winding of the winch drum in a first gearing ratio and in a second gearing ratio, the first and second gearing ratios being selected depending on the direction of rotation of the manual drive spindle, the winch further comprising:

a first gear train providing the first gearing ratio, the first gear train having a first unidirectional drive means operable to drive the main drive gear when the first unidirectional drive means is rotated in a forward direction and operable to freewheel when the first unidirectional drive means is rotated in a reverse direction; and a second gear train providing the second gearing ratio, the second gear train having a second unidirectional drive means operable to drive the main drive gear when the second unidirectional drive means is rotated in a reverse direction and operable to freewheel when the second unidirectional drive means is rotated in a forwards direction, wherein the winch is capable of motorised operation in which the winch drum is operatively linked to the motor gear shaft via at least part of the first or second gear train, so that rotation of the motor gear shaft in a first direction drives the main drive gear and causes forward winding of the winch drum and rotation of the motor gear shaft in direction opposite the first direction allows reverse winding of the winch drum, and wherein the manual drive spindle is provided with a spindle gear wheel which engages, during manual operation of the winch, with gear wheels of the first and second gear trains simultaneously to prevent reverse winding during manual operation, the spindle gear wheel being reversibly moveable out of engagement with at least one of said gear wheels of the first and second gear trains for motor-controlled reverse winding of the drum.

* * * * *